US005403232A

United States Patent [19]

Helm et al.

[11] Patent Number: 5,403,232

[45] Date of Patent: Apr. 4, 1995

[54] UTILITY DISTRIBUTION SYSTEM FOR FURNITURE

[75] Inventors: Randall S. Helm, Kentwood, Mich.; James R. Ahart, St. Louis, Mo.

[73] Assignee: Steelcase Inc., Grand Rapids, Mich.

[21] Appl. No.: 60,823

[22] Filed: May 10, 1993

Related U.S. Application Data

[63] Continuation-in-part of Ser. No. 639,513, Jan. 10, 1991, Pat. No. 5,209,035.

[51] Int. Cl.[6] ..... F24F 7/08

[52] U.S. Cl. ..... 454/230; 454/306; 454/903

[58] Field of Search ..... 454/230, 231, 232, 233, 454/306, 903

[56] References Cited

U.S. PATENT DOCUMENTS

| | | | |
|---|---|---|---|
| 2,032,103 | 2/1936 | Tise | 454/903 X |
| 2,551,751 | 5/1951 | MacDougall, Jr. | 454/233 X |
| 2,595,408 | 5/1952 | Quest | 454/903 X |
| 2,625,822 | 1/1953 | Follansbee et al. | 454/232 |
| 2,882,835 | 4/1959 | Buchanan . | |
| 3,049,067 | 8/1962 | Claude . | |
| 3,533,200 | 10/1970 | Zoebelein . | |
| 3,789,747 | 2/1974 | Wasserman et al. . | |
| 3,835,758 | 9/1974 | Bean . | |
| 3,920,299 | 11/1975 | Propst et al. . | |
| 3,956,977 | 5/1976 | Turko et al. . | |
| 4,002,109 | 1/1977 | Hori et al. . | |
| 4,072,187 | 2/1978 | Lodge . | |
| 4,094,256 | 6/1978 | Holper et al. . | |
| 4,286,419 | 9/1981 | Treffers . | |
| 4,351,475 | 9/1982 | Hudson . | |
| 4,370,155 | 1/1983 | Armbruster . | |
| 4,378,727 | 4/1983 | Doss . | |
| 4,399,739 | 8/1983 | Dean . | |
| 4,409,889 | 10/1983 | Burleson . | |
| 4,506,595 | 3/1985 | Roberts et al. . | |
| 4,535,577 | 8/1985 | Tenser et al. . | |
| 4,625,633 | 12/1986 | Martin . | |
| 4,784,445 | 11/1988 | Ott . | |
| 4,872,397 | 10/1989 | Demeter et al. . | |
| 4,942,805 | 7/1990 | Hellwig et al. . | |
| 4,950,871 | 8/1990 | Pollak et al. . | |
| 4,974,915 | 12/1990 | Bussard | 454/230 X |
| 5,065,668 | 11/1991 | Mitchell et al. . | |
| 5,065,832 | 11/1991 | Mark . | |
| 5,074,116 | 12/1991 | Kadotani et al. . | |
| 5,238,452 | 8/1993 | Levy et al. | 454/306 |

FOREIGN PATENT DOCUMENTS

| | | | |
|---|---|---|---|
| 63-83541 | 4/1988 | Japan . | |
| 63-04050 | 8/1988 | Japan . | |
| 161547 | 6/1992 | Japan | 454/306 |

OTHER PUBLICATIONS

"A Totally Integrated Work Station at the Control of the Occupant", James W. Hudson; BC&M Yearbook magazine, 1984–85, vol. II, p. 15.

"Displacement Ventilation–High–Tech, High–$$ Solution", Indoor Air Quality Update, Jun. 1991, pp. 11–15.

"Personalized Air System (PAS)", Structural Concepts Corp., date and author unknown.

(List continued on next page.)

*Primary Examiner*—Harold Joyce

*Attorney, Agent, or Firm*—Price, Heneveld, Cooper, DeWitt & Litton

[57] ABSTRACT

A ventilation system is provided for communicating ventilation air through a modular furniture arrangement, such as open office partition panel systems or the like. The ventilation system includes an air source, and a collapsible duct connected to the air source. The collapsible duct can be routed through interior spaces in partition panels in a collapsed state to facilitate routing and installation. After installation, the collapsible duct can be inflated for use, at which time the collapsible duct inflates to a maximum size to minimize resistance to air flow. Multiple secondary openings distribute the ventilation air in the collapsible duct to various worksurfaces as desired. A pressure relief valve is attached to the collapsible duct to prevent over-pressurization of the collapsible duct.

31 Claims, 24 Drawing Sheets

OTHER PUBLICATIONS

"System Technodrant", H. Krantz GmbH & Co. the date and author being unknown.
Product brochure, Pulse Inc., Allentown Pa., James L. Harter, Sr., date unknown.
"Trianon", Center Core Inc., South Plainfield, N.J., the author and date being unknown.
"Airflow Plus", Center Core Inc., South Plainfield, N.J., the author and date being unknown.
"TAB Humanetics Group Clusered Workcenter", TAB Prod. Co., CA, the author and date being unknown.
"Klimadrant", H. Krantz GmbH & Co., the date and author unknown.
"To Improve Office Design -Blow It Up", Hams F. Levy, Argon Corp., & Eric van Merkensteijn, Assoc. Dean, Univ. of Pa., Oct. 30, 1987.
"Implications of User-Based Environmental Control Systems: Three Case Studies", P. Drake, P. Mill & M. Demeter.
"Strategies for Health Promotion through User-Based Environmental Control: A Select International Perspective", P.Drake et al., publication title and date unknown (but pp. 14–21 are included).
"Klimadrant", Klima & Kalte GmbH, publication unknown.
"Boden—und Tischluftauslasse fur Buroraumklimatisierung System Technodrant", H. Krantz GmbH & Company, publication date unknown.
"Task Air Personal Comfort System", Tate Access Floors, Inc., Sep. 1986.
"Personal Environments Design Guide", Johnson Controls of Milwaukee, Wis., Apr. 1989.
"Personal Environments disclosing ventilation systems", Johnson Controls, Milwaukee, Wis., 1989.
"Climadesk", Mikroklimat Sweden AB, publication date unknown.
"Personalized Air System (PAS)", Structural Concepts Corp., Spring Lake, Mich., publication date unknown.

7C
148
7B
150
149

7C
64
XVIII
63
XIX
64
58
60
150
149
XX
XX
64
61
64
62
XVIII
XIX 3
7C
65
22C
58
63
7C
22C
59
58
65
61
30
64
22A
8A 149
61
64
30
22A
8A
3
62

UTILITY DISTRIBUTION SYSTEM FOR FURNITURE

This is a continuation-in-part application of U.S. application Ser. No. 07/639,513, filed Jan. 10, 1991 (now U.S. Pat. No. 5,209,035) by inventors R. Hodges and G. Weller entitled "UTILITY PANEL SYSTEM".

BACKGROUND OF THE INVENTION

The present invention relates to modular furniture arrangements for open office spaces, and the like, and in particular to a utility distribution system therefor.

Portable partition systems for open office spaces, and other similar settings, are well known in the art. Individual partition panels are interconnected in different configurations to form separate offices or workstations. The partition panels are extremely durable, and can be readily disassembled and reassembled into alternative configurations to meet the ever changing needs of the user. Examples of such partition systems are provided in U.S. Pat. Nos. 3,822,146; 3,831,330; and 4,144,924, which are owned by Steelcase Inc., the assignee of the present application.

Most such partition panels are capable of being electrified in some fashion, so as to provide electrical power at the various workstations for computers, typewriters, dictating equipment, and other electrical appliances. These partition panels are also typically capable of routing cabling for telephones, computers, signaling, etc. to the individual workstations. Examples of such panel wiring systems are disclosed in U.S. Pat. Nos. 4,429,934; 4,060,294; 4,228,834; 4,382,648. Wireways and/or raceways are normally provided within the interiors of the panels to carry the utilities throughout the panel system.

The space available in present panel systems for utility raceways is rather limited. This is particularly true of some of the older style partition panel systems. The advent of computerized workstations, with sophisticated communication systems, and other electronic support equipment has greatly increased the need for partition panels to carry more power and cabling throughout the panel system.

Since many users have already made a design commitment, as well as a substantial financial investment in a particular type of existing partition panel system, which panel system is otherwise fully functionable and operable, it would clearly be beneficial to be able to easily adapt each such existing panel system for use in workstations having high intensity electrical requirements. Furthermore, it would also be highly beneficial to adapt such existing partition panel systems in a way that preserves their original aesthetic design theme or look, so as to avoid a cobbled or fragmented appearance.

Another problem of portable partition systems and other forms of modular furniture systems is the potential result of poor or uneven distribution of ventilation air at the workstations due to the impeding of air flow by the furniture units. Some workstation ventilation systems have been developed, but the known systems require large capital expenditure, lack aesthetics, and require a difficult or disruptive installation. It would be highly beneficial to communicate ventilation air through the interior space of a panel system, however this must be done without complicating or compromising the ability of the panel system to carry or route power lines and cabling.

SUMMARY OF THE INVENTION

One aspect of the present invention is to provide a utility panel system, wherein each panel has a relatively thick, skeleton-like frame, with a foot and opposite sides shaped for connection with like panel frames to create a substantially freestanding utility panel system. Cover panels are detachably connected to the opposite faces of the panel frame to enclose the same, and provide ready access to the panel interior. Horizontal utility troughs extend continuously between the opposite sides of the panel frame in a vertically stacked relationship. The utility troughs have open ends located at the opposite panel sides, such that when adjacent panels are interconnected in a side-by-side relationship, the utility troughs are aligned to form multiple raceways.

Panel connectors are preferably provided to connect the utility panels with one or more of a variety of existing partition panels, and thereby permit the utility panels to act as a spine which supplies utilities to the existing partition panels.

In another aspect of the present invention, each panel frame includes at least two vertical uprights positioned adjacent the ends of the utility troughs, which extend laterally outwardly thereof to avoid encroachment into the horizontal raceways, and simultaneously create at least one vertical raceway through the interior portion of the utility panel. Communication between the horizontal and vertical raceways permits utilities to be routed therebetween within the interior of the utility panel.

In another aspect of the present invention, a collapsible duct is provided including an elongate duct having a closed interior defined by a sidewall constructed from a thin, substantially imperforate, flexible film. The duct is configured to conduct ventilation air, and has a first opening shaped to communicate with a source of pressurized ventilation air, and a second opening shaped to communicate with at least one diffuser to disperse ventilation air into an associated workspace. The duct has a nonrigid and nonreinforced construction which permits the duct to be laterally collapsed and locally deformed to facilitate threading the duct through associated furniture units, such as partition panels, whereby during operation, pressurized ventilation air from the source inflates the duct and automatically expands the same laterally to a configuration which maximizes ventilation air flow therethrough, while minimizing resistance to the flow.

The principle objects of the present invention are to provide a utility panel system capable of providing increased power and cabling to the various workstations in an open office arrangement. Each utility panel is relatively thick, with multiple horizontal troughs which align when adjacent utility panels are interconnected. Panel connectors are provided for the attachment of existing partition panels, such that the utility panels function as a spine to supply utilities to each string of partition panels, thereby extending the effective life of existing partition panel systems. The utility panels are preferably configured so that they are visually and functually compatible with the existing partition system. Further, the utility panels and panel connectors are preferably universal in structure, such that the utility panel system can be readily adapted for use with a plurality of different types of partition panel systems. Removable panel surfaces facilitate ready access to the panel interiors to facilitate wiring and the like. An open, skeleton-like panel framework provides a very rigid, yet lightweight structure with sufficient interior space to house increased utilities, as well as to mount various equipment either partially or wholly within the confines of the panel. Further, a collapsible duct is positionable in the interior space of the framework to facilitate distribution of ventilation air without complicating or compromising the ability of the panel system to carry utilities or to route utilities in the panel system. The utility panel has an uncomplicated design that can be easily and quickly assembled, is efficient in use, economical to manufacture, capable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
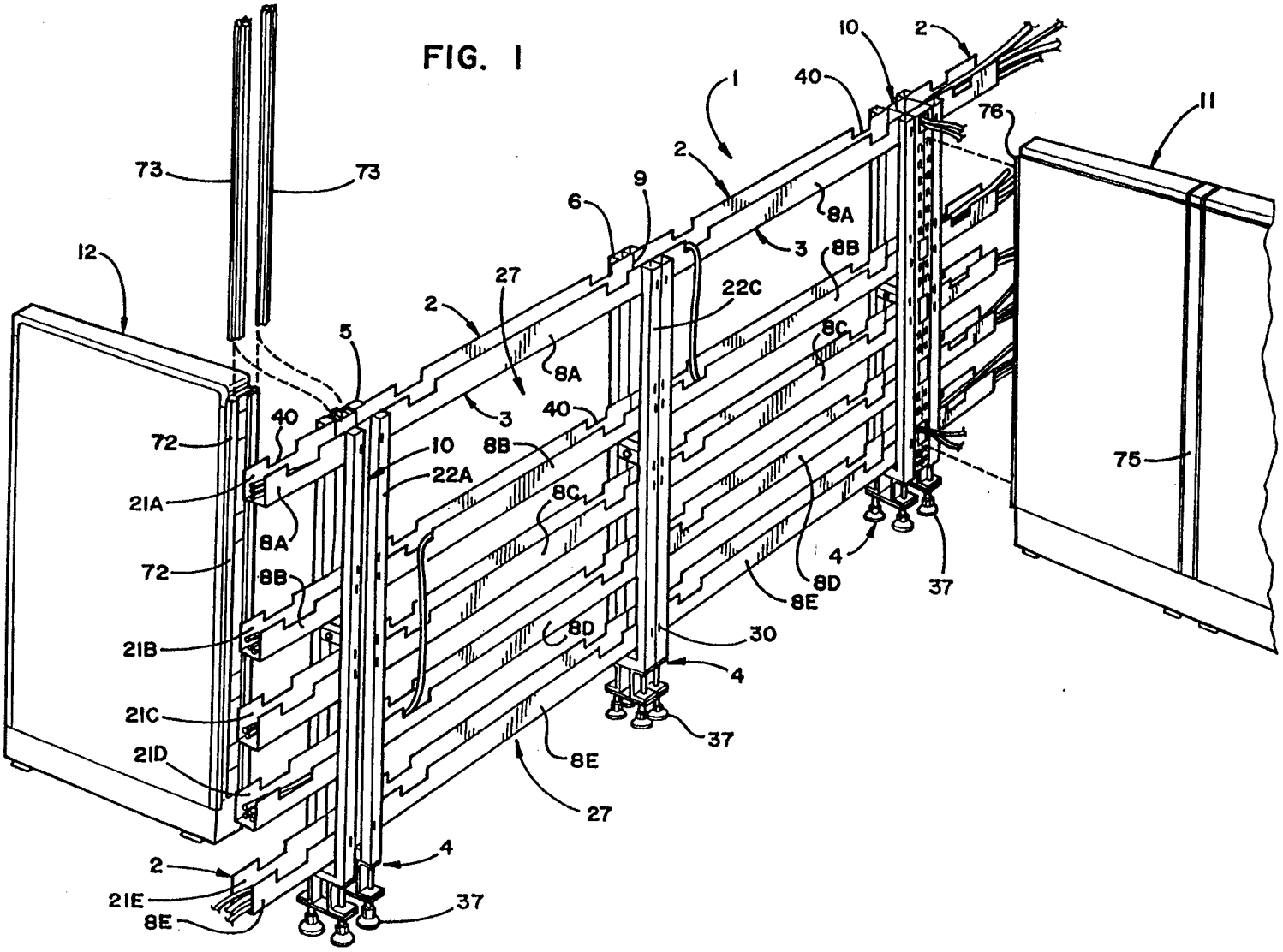
FIG. 1 is a perspective view of a utility panel system embodying the present invention, wherein utility panels, and existing partition panels are shown in a partially disassembled condition.

For purposes of description herein, the terms "upper", "lower", "right", "left", "rear", "front", "vertical", "horizontal", and derivatives thereof shall relate to the invention as oriented in FIGS. 1–5. However, it is to understood that the invention may assume various alternative orientation and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless tile claims expressly state otherwise.

The reference numeral 1 (FIG. 1) generally designates a utility panel system embodying the present invention. In the illustrated example, a plurality of individual utility panels 2 are provided, each having a relatively thick, skeleton-like frame 3, with a foot 4 and opposite sides 5 and 6 shaped for connection with like panel frames 3 to create a substantially freestanding utility panel system. Removable cover panels 7 (FIGS. 2 and 3) are detachably connected to the opposite faces of each of the panel frames 3 to enclose the same, and provide ready access to the panel interior. Horizontal utility troughs 8 (FIG. 1) extend continuously between the opposite sides 5 and 6 of each panel frame 3 in a vertically stacked relationship. The utility troughs 8 have open ends 9 located at the opposite panel sides 5 and 6, such that when adjacent utility panels 2 are interconnected in a side-by-side relationship, the utility troughs 8 are aligned to form multiple raceways in which various utilities can be carried. Panel connectors 10 are provided to connect the utility panels 2 with each other, and/or one or more of a variety of existing partition panels, such as the partition panels 11 and 12 illustrated in FIG. 1. In this configuration, utility panels 2 function as a spine which supplies utilities to strings of existing partition panels 11 and 12.

As will be appreciated by those skilled in the art, utility panel system 1 is particularly adapted to route a wide variety of different utilities to the individual workstations within the open office. In the present example, utility panel system 1 is particularly adapted to route electrical wiring, and the like, such as 110 volt and 220 volt power lines, signal cables, communication lines, and other similar wiring and cabling that is required to equip and support modern office equipment. However, it is to be understood that other forms of utilities, such as fluid pipes for water, cooling, gases, fuels and the like, as well as air conditioning ducts, and other related utilities can also be routed through the utility panel system 1, such that the term "utilities", as used herein, is intended to include all such facilities.

With reference to FIGS. 3–6*a*, each utility panel 2 has a substantially similar construction, such that common reference numerals shall be used throughout for ease of description. Each utility panel 2 comprises an open skeleton-like frame 3 on which cover panels 7 are supported. A top cap 15 is provided to enclose and trim the upper portion of utility panel 2, and a base assembly 16 provides a utility power system along the lower portion of the utility panel 2, as described in greater detail hereinafter.

The illustrated panel frame 3 includes five separate utility channels or troughs 8*a–*8*e*, each of which extends generally horizontally between the opposite sides 5 and 6 of utility panel 2. Utility troughs 8*a–*8*e* are arranged in a mutual parallel, vertically stacked relationship. Each utility trough 8*a–*8*e* has a generally U-shaped side elevational configuration adapted to receive and retain various utilities therein. Utility troughs 8*a–e* are substantially identical in construction, and include a base or web 18, with a pair of upstanding flanges 19 and 20 at opposite sides of web 18. Utility troughs 8*a–e* are relatively wide, in the nature of 2–3 inches, and deep around 3–4 inches, and form channel-shaped wireways or raceways 21*a–e* designed for maximum utility carrying capacity, without unnecessarily impinging upon the interior space of utility panel 2. Utility troughs 8*a–e* are extremely rigid, and in the illustrated example, are constructed from formed sheet metal. Utility troughs are preferably constructed extremely rigid so that they not only form secure raceways 22*a–e*, but also provide structural rigidity and support to the overall panel frame 3.

Four vertical uprights 22*a–d* are positioned adjacent the opposite ends of utility troughs 8*a–e*, and are shaped to support cover panels 7 thereon. Vertical uprights 22*a–d* are positioned at the exteriors of utility troughs 8*a–e*, and extend laterally outwardly therefrom to avoid encroachment into the horizontal utility raceways 21*a–e*, and simultaneously create two vertical raceways 27 on opposite sides of the interior of the associated utility panel 2. In the illustrated example, vertical uprights 22 are substantially identical in construction, and comprise a rigid, hollow extrusion or tube which has a substantially rectangular horizontal cross-sectional shape (FIG. 6), comprising front and rear faces 23 and 24, and interior and exterior side faces 25 and 26 respectively. The rear faces 24 of vertical uprights 22*a–d* are fixedly attached to the exterior surfaces of flanges 19 and 20 of each of the utility troughs 8*a–e*. In the example shown in FIGS. 6 and 6A, the exterior side faces 26 of vertical uprights 22*a–d* are positioned in-line or flush with the ends 9 of the associated utility troughs 8*a–e*. Vertical uprights 22*a–d* and utility troughs 8*a–e* may be fixedly interconnected by a variety of different fastening techniques, and in the illustrated example are welded together. The rigid nature of both vertical uprights 22*a–d* and utility troughs 8*a–e*, as well as their rigid interconnection, creates a very strong and rigid open grid or skeleton-like frame 3, which does not require any auxiliary cross-bracing or the like, thereby maximizing the usable space within the interior of the utility panel 2.

Figure 5:
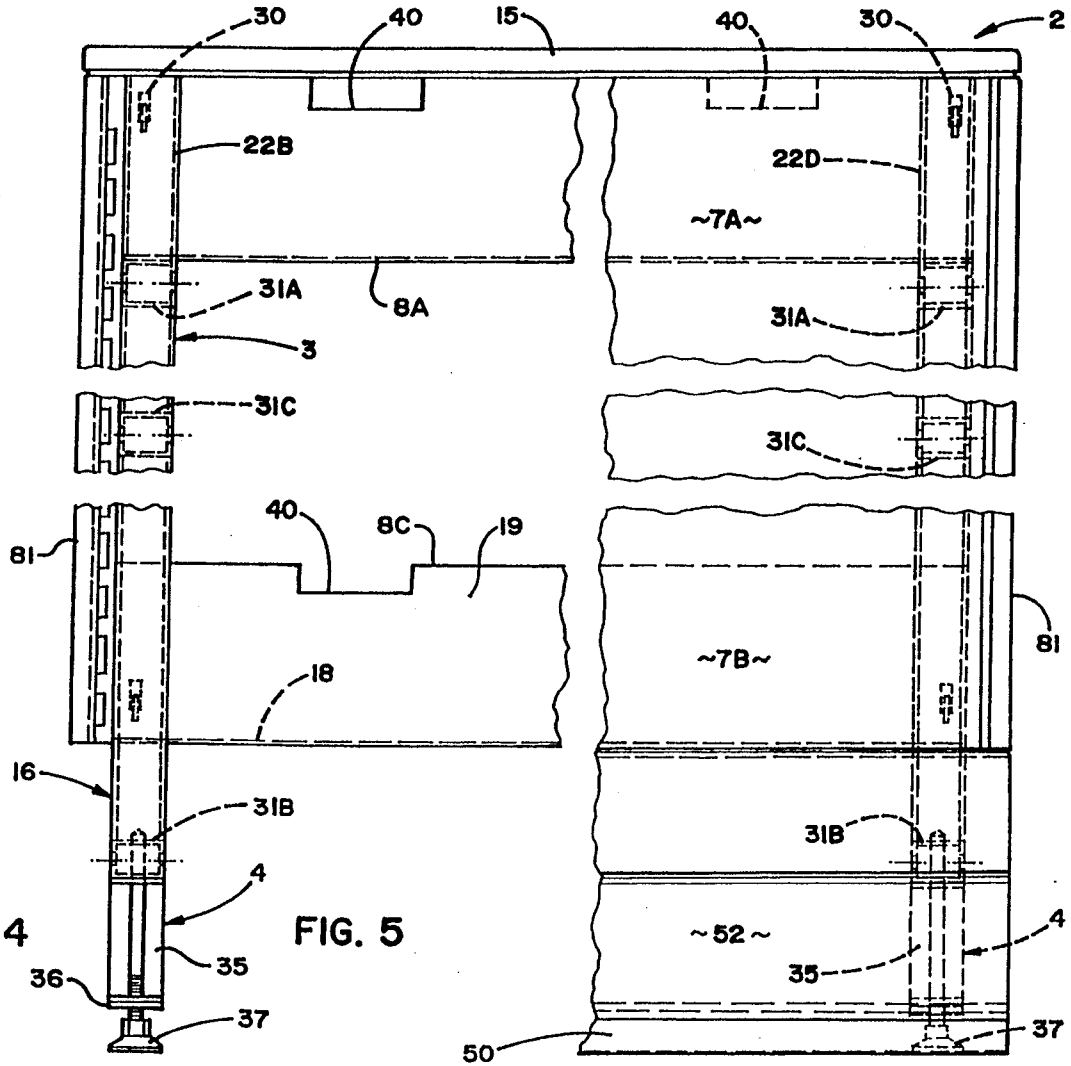
FIG. 5 is a fragmentary, front elevational view of the utility panel.
Figure 4:
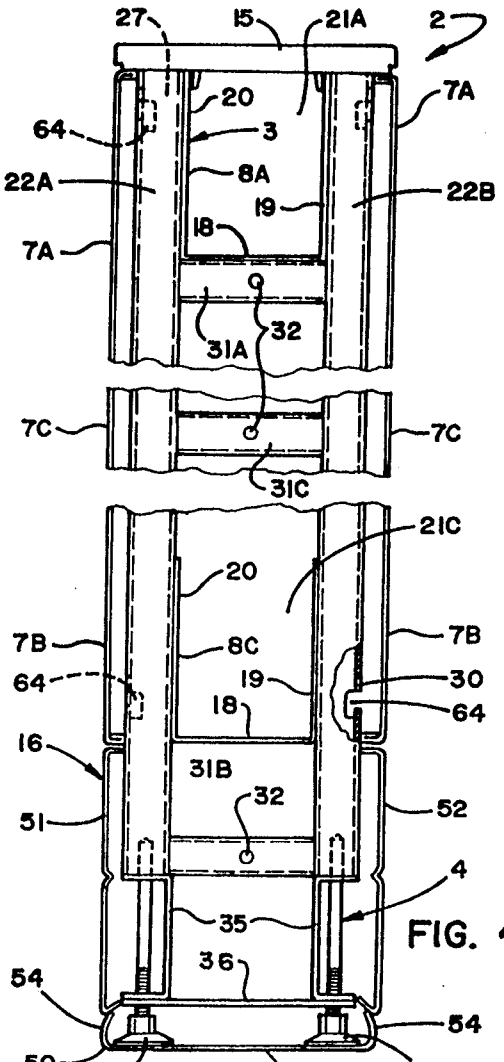
FIG. 4 is a fragmentary, side elevational view of the utility panel.

In the example illustrated in FIGS. 1–7A, each vertical upright 22*a–d* includes a plurality of hanger slots 30 extending through the front face 23 thereof into which hook shaped portions 64 of cover panels 7 are received, as described in greater detail hereinafter. Panel frame 3 includes three lateral connector brackets 31*a–c* disposed at the opposite ends of frame 2, which serve in interconnecting adjacent frames 3 in a side-by-side relationship. As best illustrated in FIGS. 4 and 5, connector brackets 31*a–e* have a rectangular tubular construction similar to vertical uprights 22*a–d*, and extend laterally inbetween the oppositely facing vertical uprights 22*a–b* and 22*c–d* respectively, with opposite ends fixedly attached thereto. The lowermost connector bracket 31*b* is positioned at the lower ends of vertical uprights 22, the uppermost connector bracket 31*a* is positioned directly below the uppermost utility trough 8*a*, and the medial connector bracket 31*c* is positioned inbetween utility troughs 8*b* and 8*c*. Each connector bracket 31*a–c* includes a fastener aperture 32 which extends laterally through the connector bracket in a direction parallel with the opposite faces of utility panel 2.

Each panel frame 3 also includes a dual glide foot assembly 4 attached to the lower ends of vertical uprights 22*a–d* at the opposite sides of utility panel 2. With reference to FIGS. 4 and 5, each panel foot assembly 4 includes a pair of C-shaped brackets 35 having their upper ends fixedly attached to the lower ends of vertical uprights 22*a–d*, and their lower ends interconnected by a rigid Strap 36. Each side of the foot assembly 4 includes a pair of threaded apertures in which glide feet 37 are threadedly received. Axial rotation of glide feet 37 with respect to foot brackets 35 adjusts the relative height of panel frame 3. By providing each foot assembly 4 with a pair of vertically adjustable glide feet 37, utility panel 2 has good freestanding support, and the angular orientation of the utility panel with respect to the floor surface can be readily adjusted.

Each of the illustrated utility troughs 8*a–e* (FIG. 3) includes two pairs of notches or cutouts 40 extending through the upper edges of channel flanges 19 and 20. The flange notches 40 are positioned generally adjacent to the opposite ends of the utility troughs 8*a–e*, and are shaped to permit wires and/or other utilities to be pulled out from the associated utility trough, and routed into and through one of the vertical raceways 27. In this manner, wires, or the like can be easily brought to a service point at various vertical heights along utility panel 2, or routed through a different one of the utility troughs 8*a–e*, as best illustrated in FIG. 1. A raceway cover 41 (FIG. 3) may be used to enclose one or more of utility troughs 8, and has an inverted U-shaped configuration, having a central web 43, and depending flanges 44 along opposite sides thereof. The flanges 44 of raceway cover 41 are spaced so as to closely receive the opposite flanges 19 and 20 of utility troughs 8*a–e* therein to form a secure, closed raceway 21. The illustrated cover 41 includes notches 45 through side flanges 44, which align with the associated notches 40 in utility troughs 8*a–e* to permit wires to be routed into and through the vertical raceways 27.

The base assembly 16 (FIGS. 3–5) serves to enclose that portion of panel frame 3 disposed below the lowermost utility trough 8*e*, and comprises an upwardly facing, U-shaped base channel 50, with a pair of removable covers 51 and 52. Base channel 50 includes a flat web 53 which extends along the floor surface, and a pair of upstanding, flexible flanges 54, which serve as light seals along the base of utility panel 2. Glide feet 35 protrude through apertures in base web 53 to engage the floor directly. The base side covers 51 and 52 are detachable connected with panel frame 3, and enclose that portion of the panel frame disposed between the light seal flanges 54 and the lowermost edge of cover panels 7. Side covers 51 and 52 are manually removable with a snap fastener, or the like, so as to readily access any utilities placed therein, such as the illustrated powerway 56. Powerway 56 is the subject copending U.S. patent application Ser. No. 377,892 filed Jul. 10, 1989, entitled Modular Powerway For Partition Panels and the Like, which is assigned to the assignee of the present application, and is hereby incorporated herein by reference. However, it is to be understood that other types of powerways, and/or wiring systems can also be used in conjunction with utility panel 2.

Cover panels 7 (FIGS. 3–5) serve to cover the opposite faces of panel frame 3. In the illustrated example, each face of panel frame 3 includes three separate removable cover panels, comprising an upper cover panel 7*a*, a lower cover panel 7*b*, and intermediate cover panel 7*c*. Cover panels 7*a–7c* have a generally similar construction, comprising a rigid, pan-shaped inner panel 58 constructed of formed sheet metal or the like, comprising a flat front face 59, and inwardly bent marginal edges 60–63. In the cover panels 7*a–c* shown in FIGS. 3–5, hook shaped tabs or fasteners 64 are mounted on the side edges 62 and 63 of inner panel 58, and are shaped to be received within the hanger slots 30 of vertical uprights 22*a–d*. A fabric, or other similar cover layer 65 may be attached to the exterior of inner panel 58, and drawn around the marginal edges 60–63 thereof, so as to present a neat finished exterior appearance. Adhesive, or other similar fastening means may be used to attach the cover layer 65 to inner panel 58.

Figure 6:
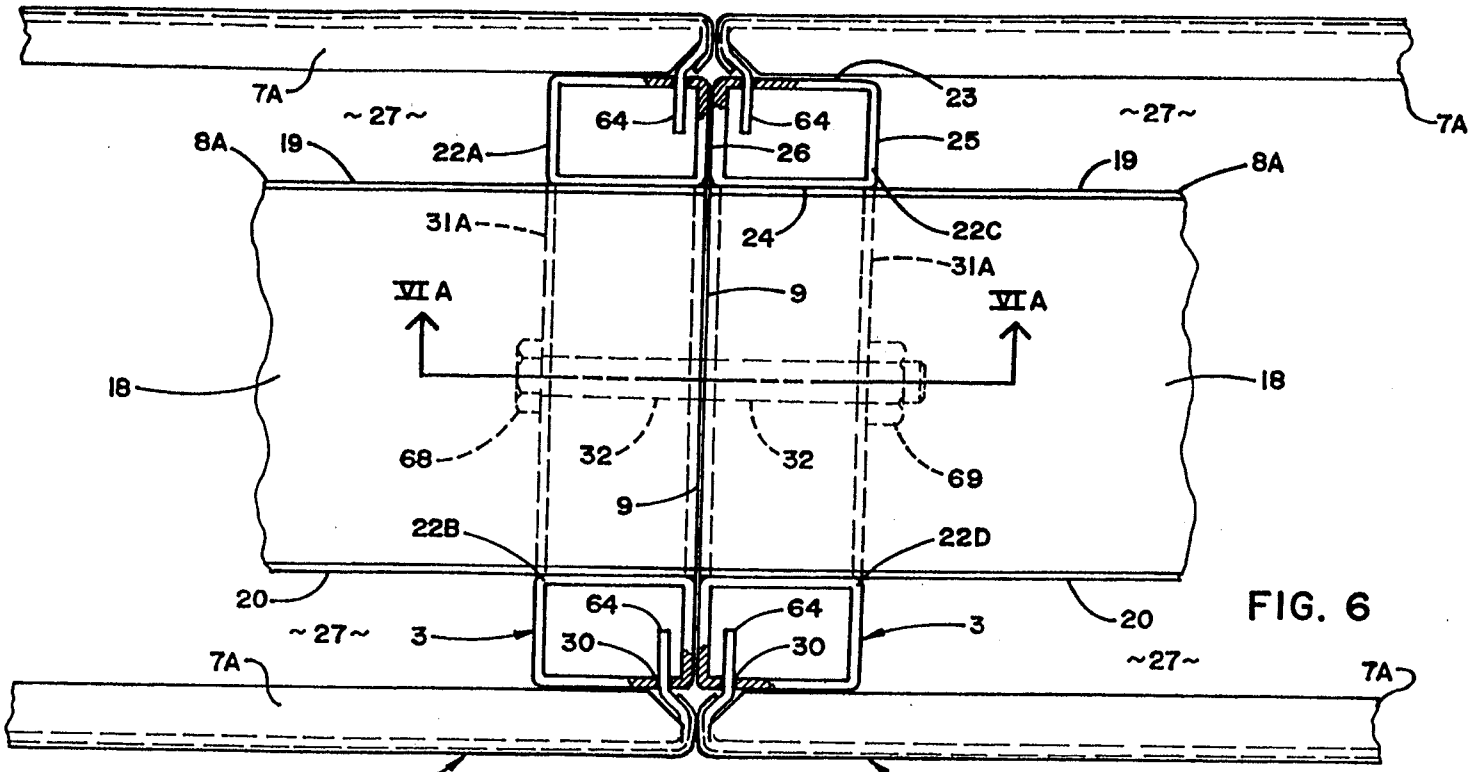
FIG. 6 is a top plan view of a pair of utility panels directly interconnected in a side-by-side relationship.
Figure 6A:
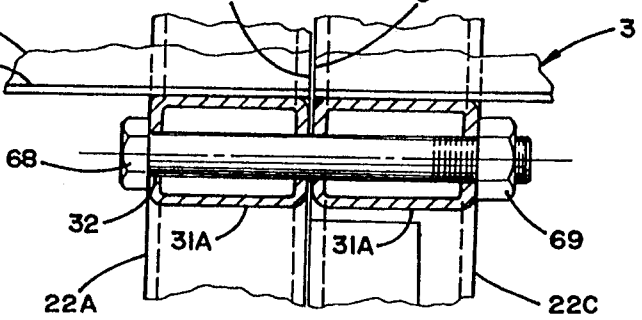
FIG. 6A is a fragmentary, vertical cross-sectional view of the directly interconnected utility panels, taken along the line VIA—VIA of FIG. 6.

Each of the cover panels 7*a–c* illustrated in FIG. 6, is shaped so that the side edges 62 and 63 are positioned substantially flush with the exterior side faces 26 of vertical uprights 22*a–d*. In this manner, when adjacent utility panels 2 are directly interconnected in a side-by-side relationship, as shown in FIGS. 6 and 6A, the side edges 60 and 61 of cover panel 7*a–c* will abut. The upper and lower edges 62 of each of the cover panels 7*a–c* are spaced apart selected distances in accordance with the spacing of utility troughs 8*a–e*, and/or location of hanging furniture articles. In the illustrated example, the upper cover panel 7*a* has a height selected such that its upper edge 60 is generally flush with the upper ends of vertical uprights 22*a–d*, while its lower edge 61 is positioned generally flush with the bottom of utility trough 8*b*. The lower cover panel 7*b* has its lower edge 61 positioned substantially coplanar with the uppermost edge of base cover 51, and its upper edge 60 positioned substantially coplanar with the top of utility trough 8*c*. Intermediate cover panel 7*c*, has its upper and lower edges 60 and 61 positioned to abut the lower edge 61 of upper panel 7*a*, and the upper edge 60 of lower panel 7*b*, respectively. In the example shown in FIG. 3, the upper edge 60 of intermediate panel 7*c* is disposed substantially coplanar with the bottom of utility trough 8*b*, and its lower edge 61 positioned substantially coplanar with the top of utility trough 8*c*. In this manner, removal of upper cover panel 7*a* provides ready access to utility troughs 8*a* and 8*b*, removal of lower cover panel 7*b* provides ready access to utility troughs 8d and 8e, and removal of intermediate cover panel 7*c* provides access to center utility trough 8*c*.

Adjacent utility panels 2 are adapted to be interconnected in a side-by-side relationship in a number of different fashions, as required by a particular installation. In the embodiment illustrated in FIGS. 6 and 6A, adjacent utility panels 2 are directly interconnected, with the exterior faces 26 of adjacent vertical uprights 22*a–d* abutting one another. The two centermost utility panels 2 illustrated in FIG. 1 are directly interconnected in this fashion. In this embodiment, through bolts 68 (FIGS. 6 & 6A) are inserted through the apertures 32 of each adjacent pair of connector brackets 31*a–c*. A nut 69 is threaded onto the free end of each bolt 68, and tightened, so that adjacent utility panels 2 are securely interconnected in the illustrated flush relationship. This type of flush interconnection can be used when it is not necessary to hang furniture articles from the utility panels 2. When utility panels 2 are interconnected in the flush relationship discussed above, the ends 9 of adjacent utility troughs 8*a–e* are aligned and in sufficiently close proximity to form a substantially continuous raceway throughout the utility panel system 1.

Alternative techniques for interconnecting adjacent utility panels 2 are illustrated in FIGS. 7–17 wherein different style panel connectors 10 are used, particularly when utility panels 2 are used as a spine to feed strings of existing partition panels, such as the illustrated partition panels 11 and 12. In the example illustrated in FIG. 1, partition panels 11 and 12 represent two different styles of existing partition panels that are presently manufactured and sold by Steelcase Inc., assignee of the present application. Partition panel 12 is a partially schematic illustration of a panel manufactured and sold by Steelcase Inc. under the "Series 9000" trademark, additional details of which are disclosed in U.S. Pat. Nos. 4,144,924 and 4,203,639, as identified in Applicant's associated Information Disclosure Statement. In general, each of the "Series 9000" partition panels 12 includes a two-piece bracket 72 mounted along both side edges thereof in which flexible hinge strips 73 are received and retained. The use of a single hinge strip 73 to interconnect adjacent "Series 9000" panels permits the 12 partition panels to be rotated with respect to one another, whereas the use of two hinge strips 73 interconnects adjacent "Series 9000" panels in a fixed in-line condition.

A different style partition panel is indicated by the reference numeral 11, and in the illustrated example, comprises a panel manufactured and sold by Steelcase Inc. under the "Valencia" trademark, additional details of which are apparent from the Applicant's associated Information Disclosure Statement. Unlike the flexible hinge connector arrangement incorporated into the "Series 9000" panel system discussed above, the "Valencia" panel system employs separate connector posts 75 to interconnect adjacent partition panels 11. Each "Valencia" brand partition panel has a pair of windowed brackets 76 (FIG. 14) attached to the opposite sides thereof, and the connector posts 75 have a mating tab bracket 77, which interlocks with the windowed bracket 76, as described in greater detail hereinafter. The "Valencia" connector post rigidly interconnects adjacent partition panels 11 in either an in-line, "T", or "X" configuration.

It is to be understood that while utility panel system 1 is disclosed herein for use in conjunction with Steelcase "Series 9000" and "Valencia" brand partition panels 11 and 12, it is equally applicable to other types of partition systems, including those associated with panel manufacturers other than Steelcase Inc.

Figure 7:
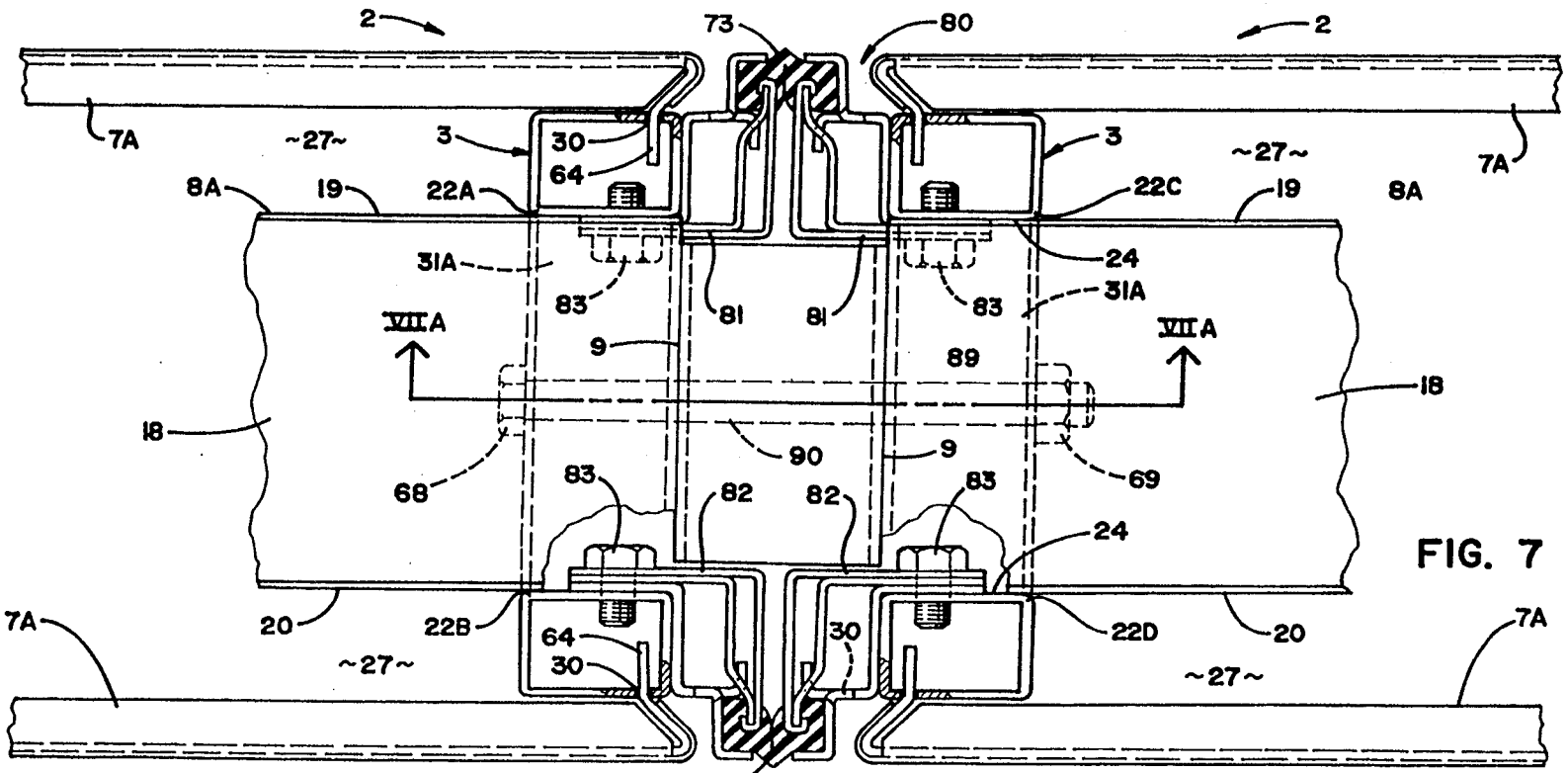
FIG. 7 is a top plan view of a pair of utility panels interconnected by an in-line panel connector.
Figure 7A:
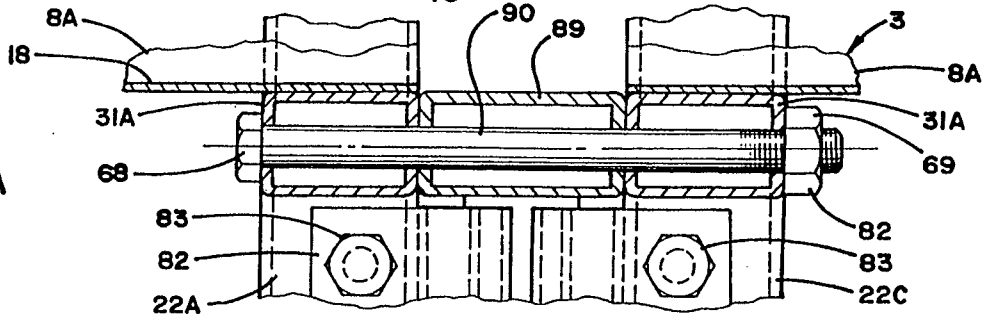
FIG. 7A is a fragmentary, vertical cross-sectional view of the utility panels and in-line panel connector, taken along the line VIIA—VIIA of FIG. 7.
Figure 10:
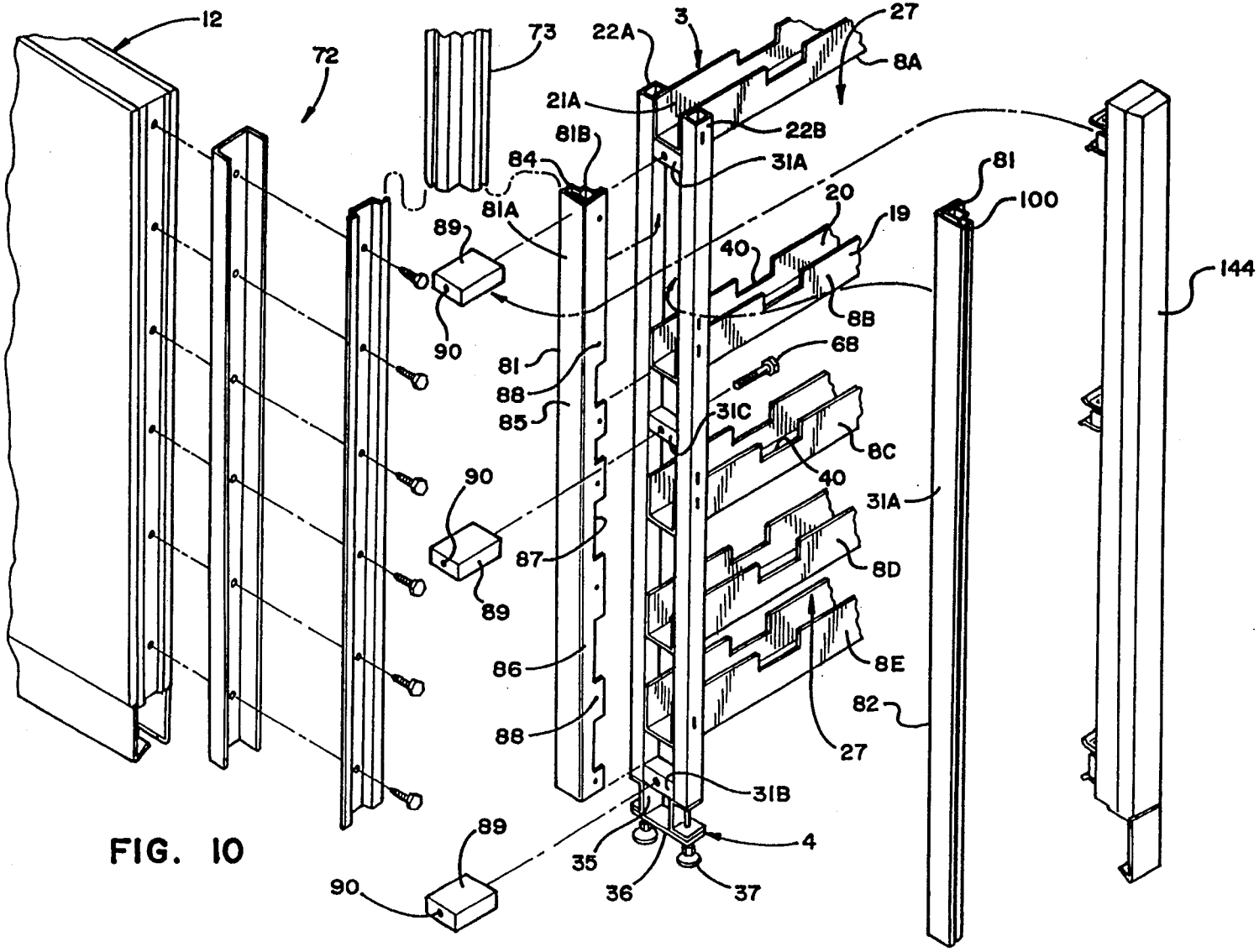
FIG. 10 is an exploded, perspective view of a utility panel and existing panel interconnected by a T-panel connector.
Figure 15:
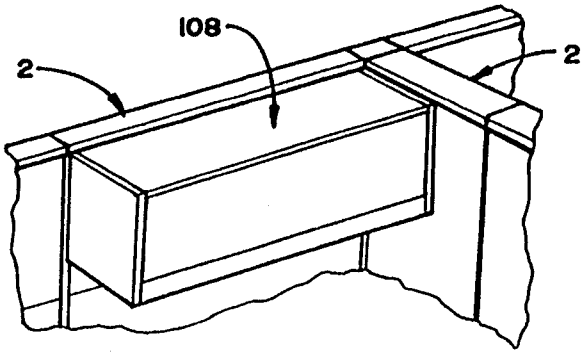
FIG. 15 is a perspective view of a storage bin mounted on a utility panel.
Figure 16:
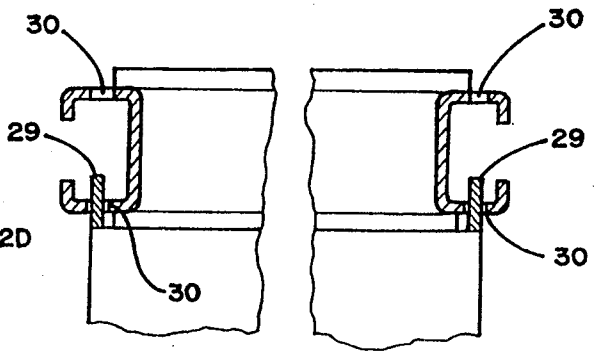
FIG. 16 is a fragmentary, cross-sectional view of the storage bin attachment to the utility panel.

The panel connector 10 illustrated in FIGS. 7 and 7A is particularly designed for interconnecting utility panels 2 that are used in conjunction with Steelcase "Series 9000" brand partition panels 12. The illustrated in-line panel connector is designated by the reference numeral 80, and in general comprises two pairs of brackets 81 and 82, which are shaped to be fastened to the rear faces 24 of vertical uprights 22*a–d* by suitable fastening means, such as the illustrated bolts 83. As best illustrated in FIG. 10, brackets 81 and 82 have a generally L-shaped top plan configuration, and are elongate, extending generally along the entire side of utility panel frame 3. Each bracket 81 and 82 has a two-part construction, with a channel 84 formed inbetween the outer and inner bracket halves 81*a* and 81*b* at the outwardly extending flange 85 thereof, which is shaped similar to the bracket 72 in the "Series 9000" panels so as to receive a flexible hinge 73 therein. The opposite flange 86 and bracket 84 includes cut out notches 87 in which the ends 9 of utility troughs 8*a–e* are received, and apertures 88 through which the fastener bolts 83 extend to mount the brackets 81 and 82 to the vertical uprights 22*a–d*. Three spacer blocks 89 are also provided, and are positioned between the three connector brackets 31*a–c* of panel frame 3. Each connector block 89 includes a longitudinally extending aperture 90 in which through bolts 68 are received, as best illustrated in FIGS. 7 and 7A. Connector blocks 89 fill in the space or gap formed between the ends 9 of adjacent utility troughs 8*a–e*, so that the raceway 21 has a substantially continuous construction. Two flexible hinges 73 (FIG. 7) interconnect both pairs of brackets 81 and 82, and thereby create a visual appearance very similar to that of the "Series 9000" panels 12 to maintain a uniform design theme.

Figures 8, 9:
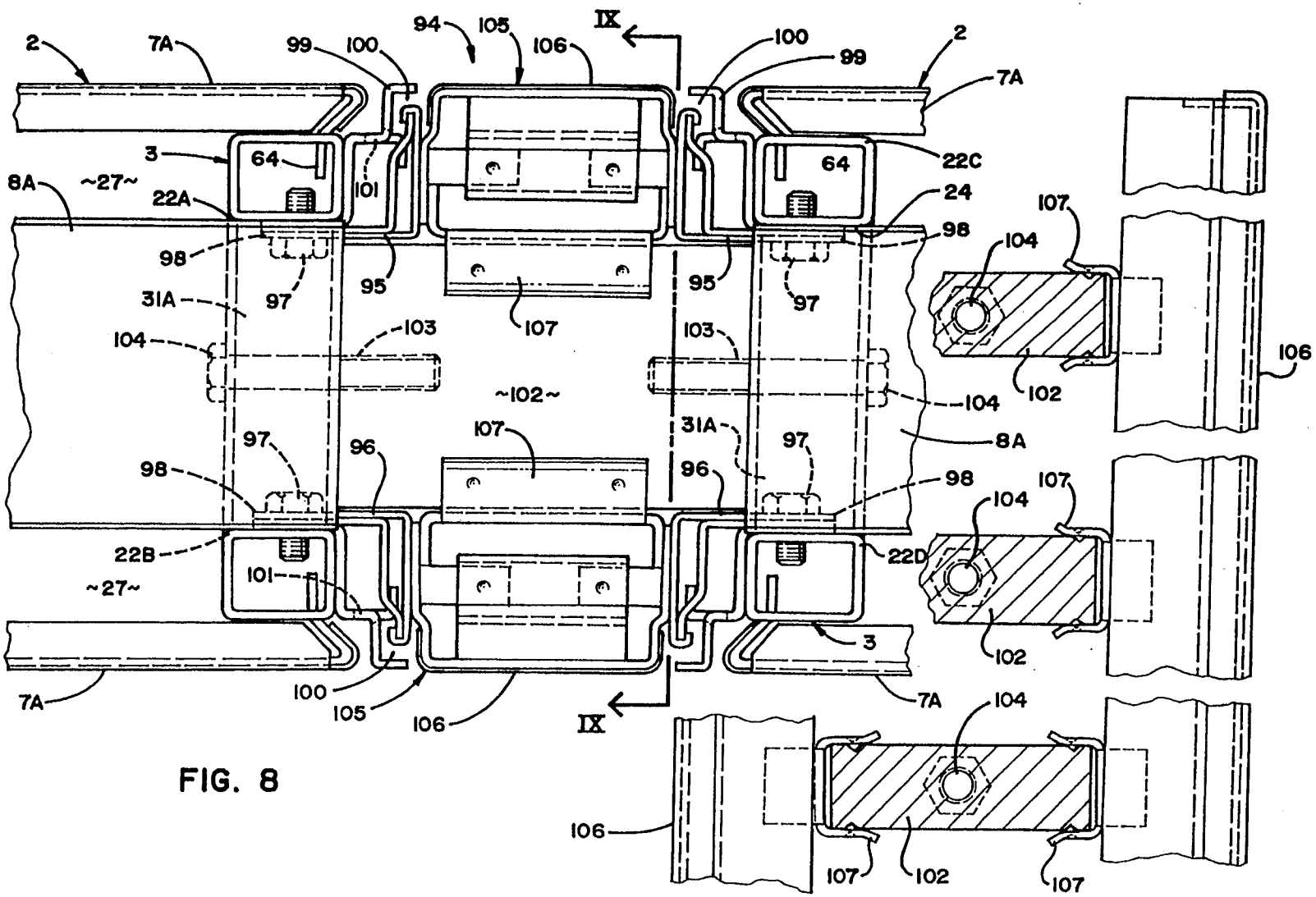
FIG. 8 is a top plan view of a pair of utility panels interconnected by a spacer panel connector.
FIG. 9 is a fragmentary, vertical cross-sectional view of the utility panels and spacer panel connector, taken along the line IX—IX of FIG. 8.

An in-line spacer connector 94 is illustrated in FIGS. 8 and 9; and is somewhat similar to the in-line connector 80 described above. Spacer connector 94 is also adapted to be used in conjunction with utility panels 2 that are to be interconnected with "Series 9000" panels 12, and includes two pairs of brackets 95 and 96, which are substantially identical to the brackets 81 and 82 of in-line connector 80. Bolts 97 attach the interior flanges 98 of brackets 95 and 96 to the rear faces 24 of vertical uprights 22*a–d*. The exterior flanges 99 of brackets 95 and 96 each carry a channel 100 in which one of the side beads of flexible hinge 73 is received, and a series of slots 101 in which furniture articles, such as the binder bin 108 illustrated in FIG. 15, may be hung. Three connector blocks 102, somewhat longer than connector blocks 89, are provided to span the distance between the three connector brackets 31*a–c* of adjacent utility panels 2. Each connector block 102 includes two threaded apertures 103 in which mounting bolts 104 are threadedly secured. A pair of filler posts 105 are positioned inbetween brackets 95 and 96, and include a generally flat outer surface 106 designed to mate aesthetically with the exterior appearance of utility panels 2. Each filler post 105 includes a plurality of inwardly facing, U-shaped clips 107 attached to the interior face thereof, in which the side edges of connector blocks 102 are received to secure filler post 105 in place. In the illustrated example, U-shaped clips 107 have a snap lock detent which mates with associated recesses in the connector blocks 102 to securely, yet removably retain the filler posts 105 in place.

Figure 11:
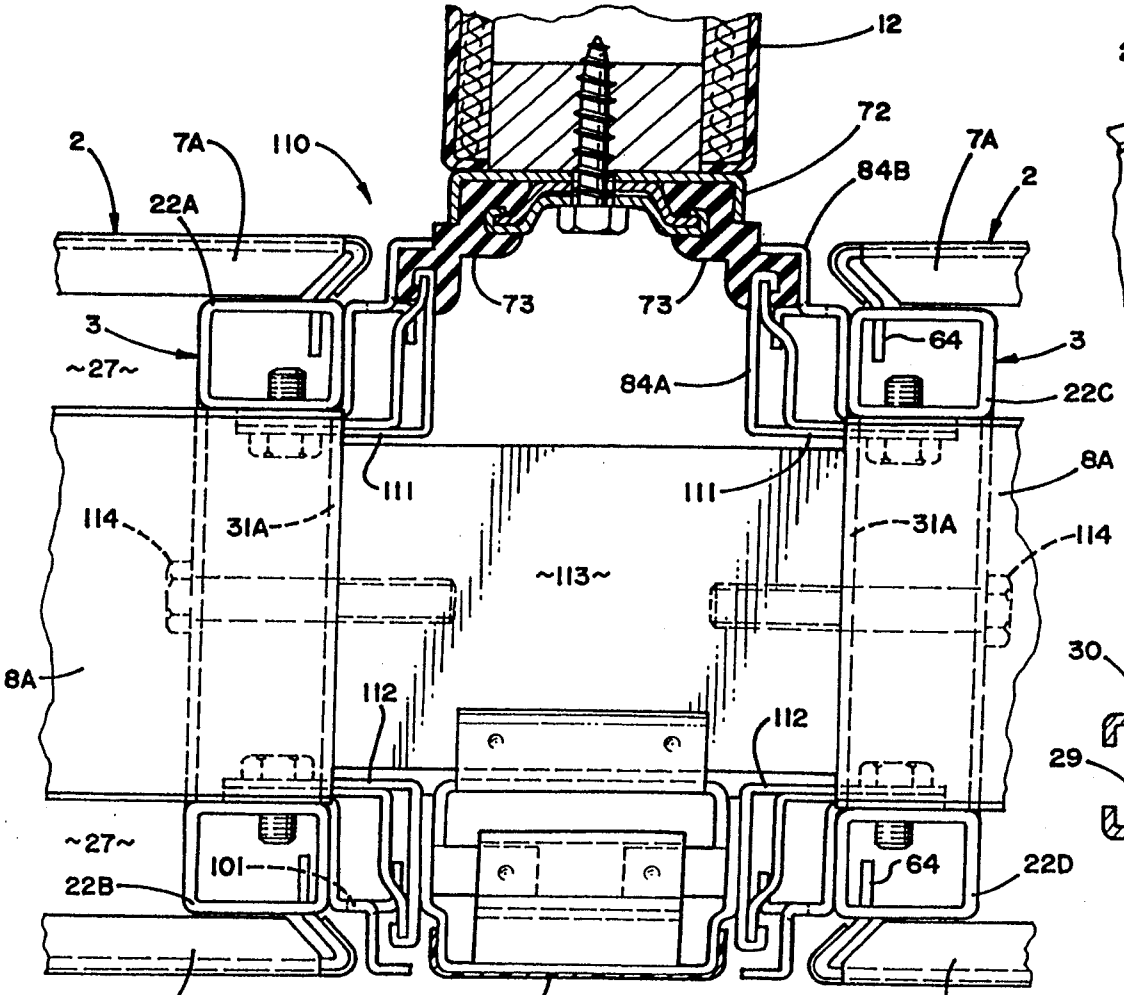
FIG. 11 is a top plan view of a pair of utility panels interconnected by a T-panel connector.

A T-panel connector 110 is illustrated in FIG. 11, and incorporates parts identical to those already described hereinabove. More specifically, T-panel connector 110 includes two pairs of brackets 111 and 112, which are substantially identical to previously described brackets 81–82 and 95–96. Three connector blocks 113, identical to connector blocks 102, extend between the three connector brackets 31*a–c* of adjacent panel frames 3, and are securely interconnected thereto by bolts 114. A single filler post 115, identical to one of the filler posts 105, is mounted on one side of the adjacent utility panels 2, and a pair of flexible hinges 73 attach a standard "Series 9000" panel 12 to the bracket pair 111 on the opposite side of utility panels 2.

Figure 12:
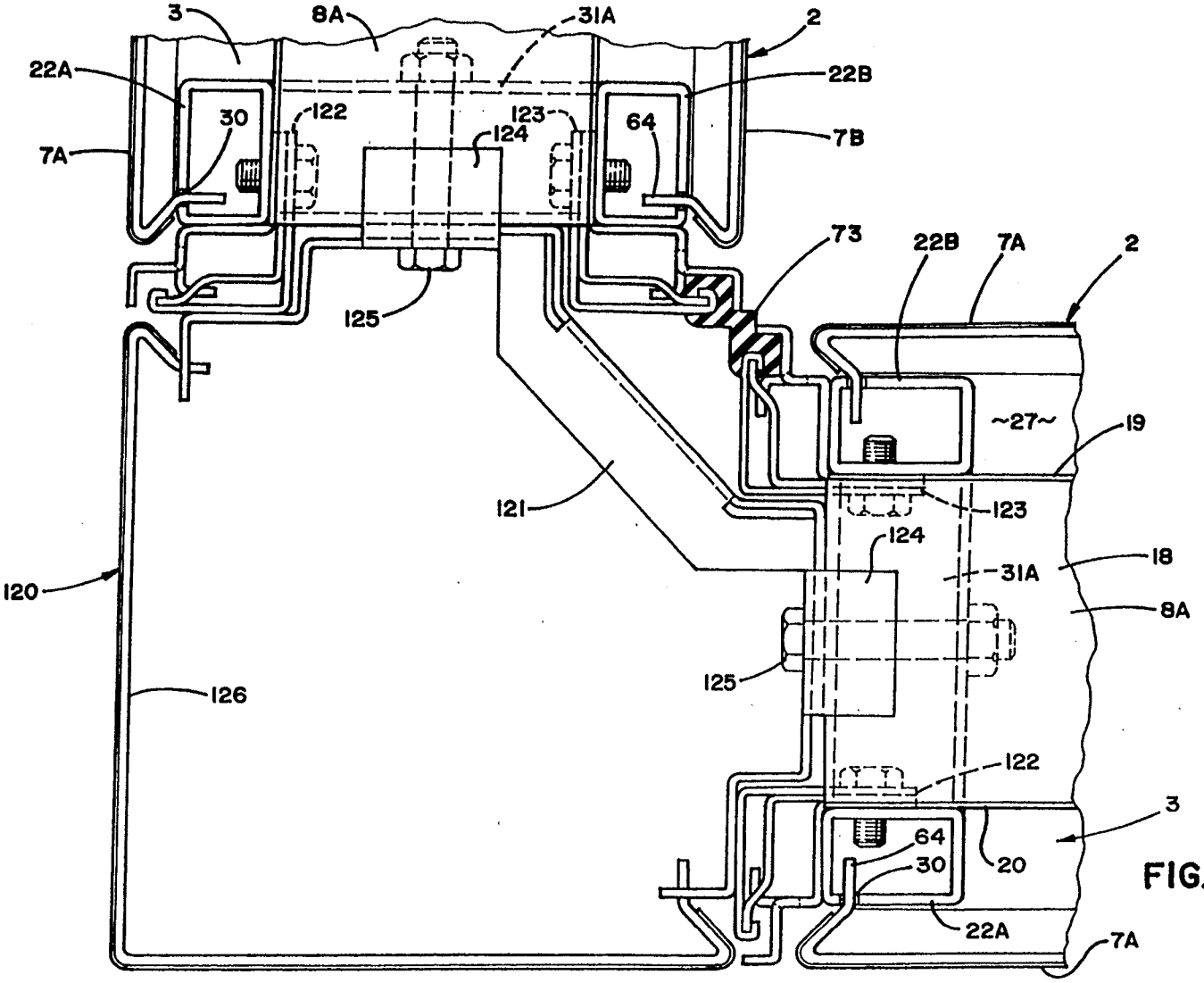
FIG. 12 is a top plan view of a pair of utility panels interconnected by an L-panel connector.

An L-panel connector 120 is illustrated in FIG. 12, and is adapted to interconnect two adjacent utility panels 2 in a 90 degree configuration. L-panel connector 120 includes a generally L-shaped frame 121 with two pairs of brackets 122 and 123, similar to brackets 81 and 82 attached to the opposite flanges thereof. U-shaped clips 124 are received over the connector brackets 31*a–c* of adjacent vertical uprights 22*a–e*, and include bolts 125 to securely interconnect the same. A single, flexible hinge 73 interconnects the bracket pair 123 on the interior side of the utility panels 2, while an L-shaped cover 126 extends between and encloses the free ends of connector frame 121.

Figure 14:
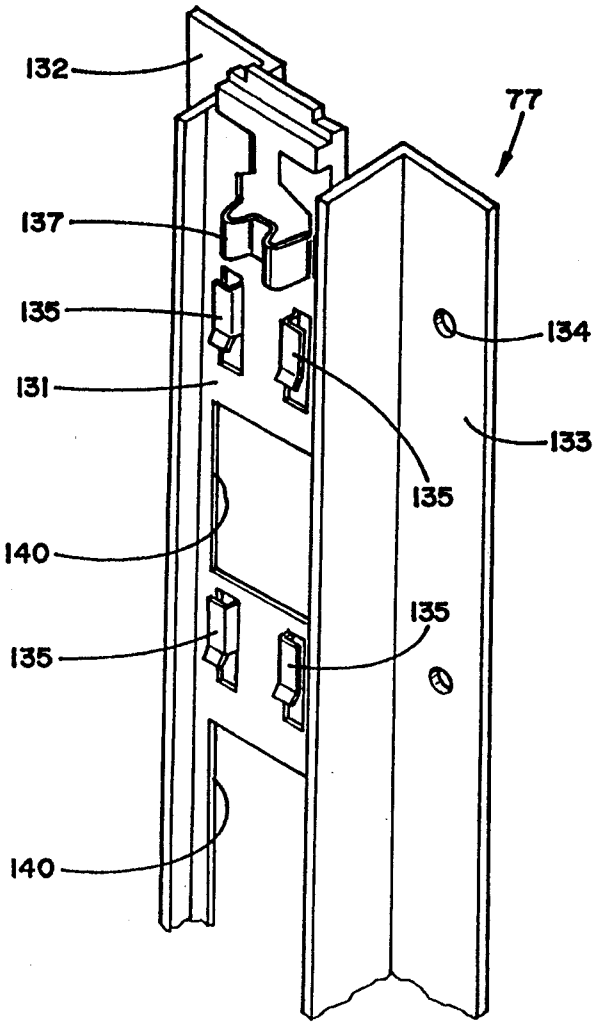
FIG. 14 is a perspective view of a panel connector adapted for use in conjunction with the partition panel illustrated in FIG. 13.
Figure 13:
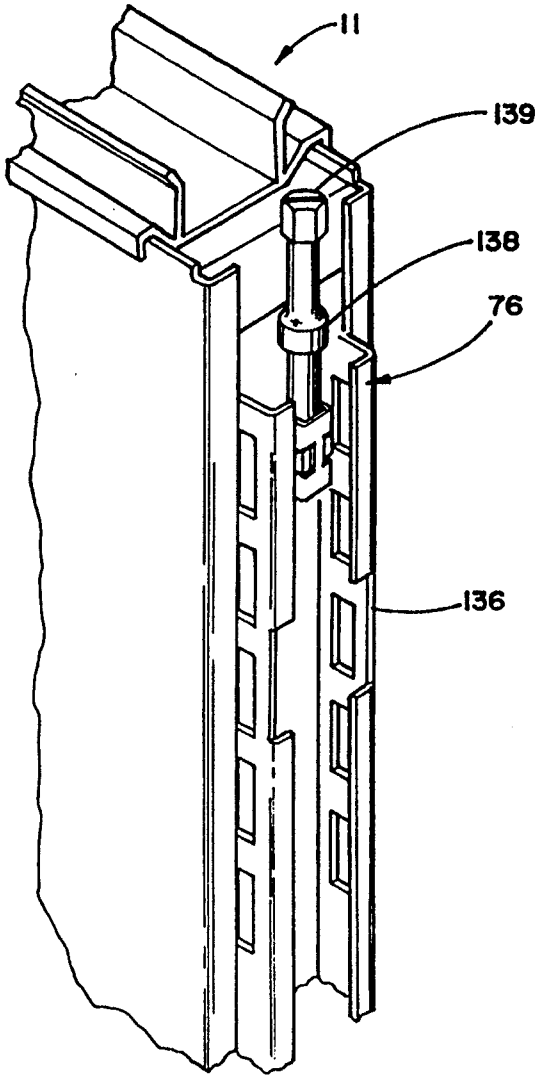
FIG. 13 is a fragmentary, perspective view of a second style existing partition panel.

An alternative T-panel connector 77 is illustrated in FIGS. 13 and 14, and is particularly adapted for interconnecting two utility panels 2 with a "Valencia" style partition panel 11 in a T-configuration. The "Valencia" T-panel connector 77 comprises a central fastener web 131, having a pair of L-shaped channels 132 and 133 fixedly interconnected along opposite sides thereof. The connector channels 132 and 133 include fastener apertures 134 through which fasteners are inserted to attach the connector 77 to the rearward faces 24 of adjacent vertical uprights 22*a* & *c* and 22*b* & *d* respectively, in a fashion substantially identical to the attachment of connector 80, as described above. In a T-configuration, a cover panel (not shown) is positioned over the connector 77 that is not attached to a partition panel 11. The web 131 of connector 130 carries outwardly protruding tabs 135 which are matingly received through windows 136 in the connector bracket 76 of an adjacent "Valencia" panel 11. A collar 137 is mounted at the upper end of web 131, and is engagingly received by an enlarged portion 138 of a lock bolt 139 on "Valencia" panel 12. Windows 140 are formed through the web 131 of connector 77, and are positioned for alignment with the utility troughs 8*a–e* of an associated utility panel 2, such that the utilities, such as wires, and the like can be routed from the utility troughs 8*a–e* of the associated utility panel 2 through bracket windows 140, and into the interior of "Valencia" panel 12.

Figure 2:
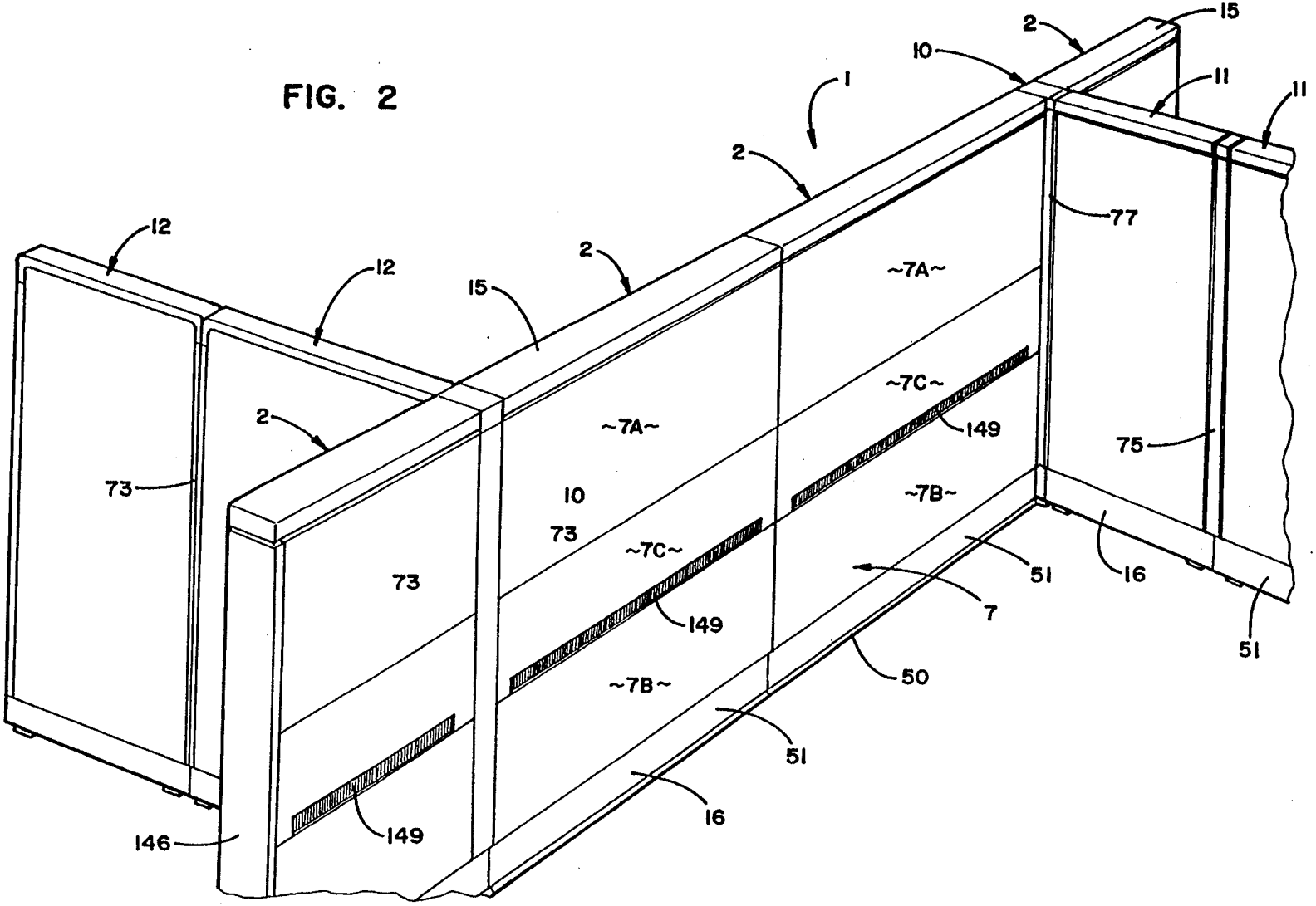
FIG. 2 is a perspective view of the utility panel system illustrated in FIG. 2, wherein the utility panels, and existing partition panels are shown in a fully assembled condition.
Figure 3:
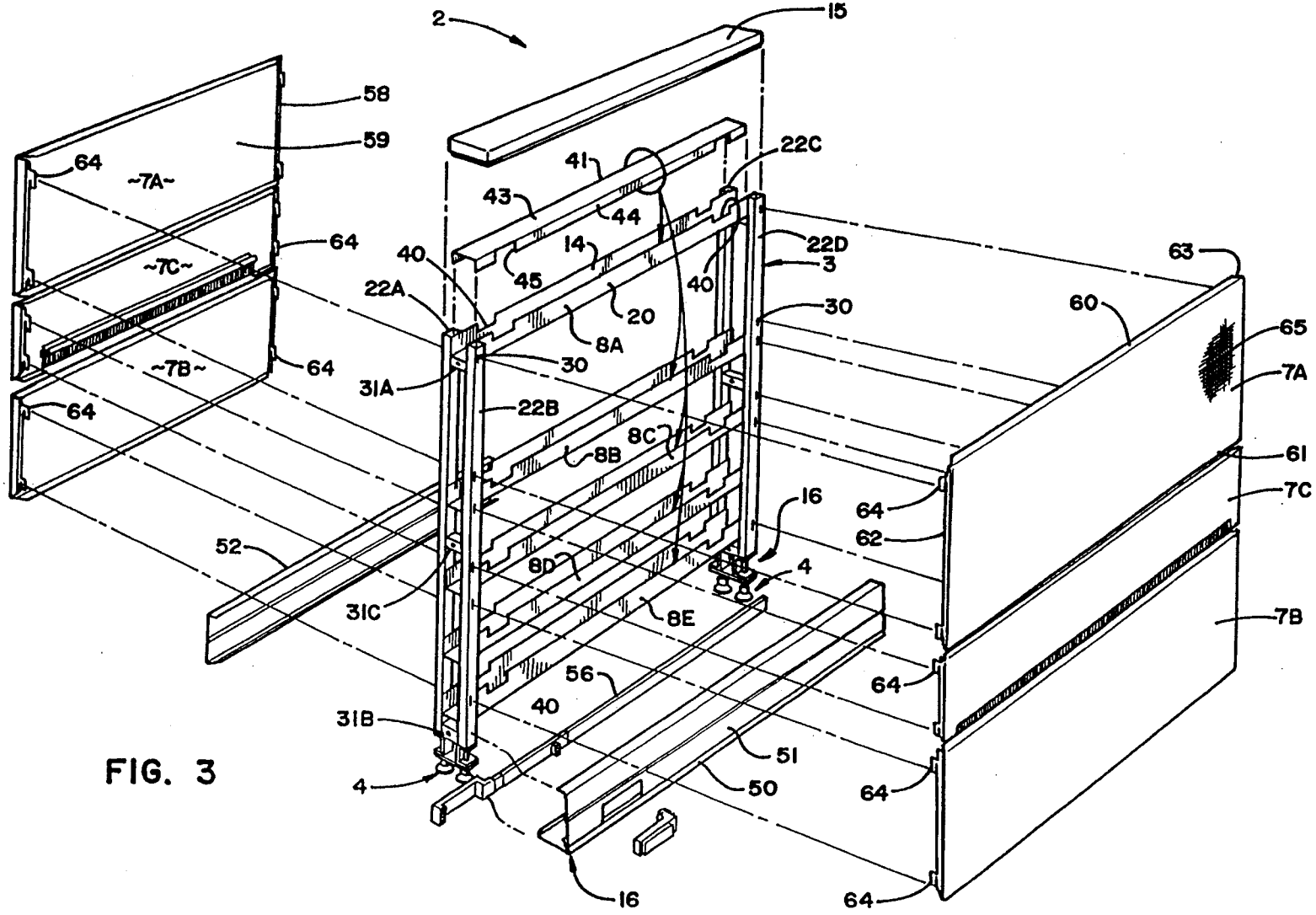
FIG. 3 is an exploded, perspective view of a utility panel.

As best illustrated in FIGS. 1 and 2, utility panels 2 are particularly adapted to be interconnected in an in-line relationship using either a flush type connection (FIG. 6–6A), or one of the panel connectors 10 to form a central spine from which strings of partition panels 11 and 12 T-off in a 90 degree orientation. The additional utility carrying capability of the utility panels 2 thereby greatly increases the effective life and operation of the existing panels 11 and 12 by adapting them for use in electrically intensive workstations. Also, the fact that different panel connectors 10 can be attached to the same utility panel 2, lends universal functionality to the utility panel system 2 and adapts the same for use with a wide variety of different types of partition systems. The different panel connectors 10 not only account for the different fastening techniques used to interconnect various partition panels, but they also replicate the outward appearance of the particular panel system, so that the utility panels 2 blend in visually as well as functionally. Superior distribution and management of communications, signal cabling and electrical power, network connections, as well as HVAC is also achieved by permitting the utility panels 2 to carry the major burden or load of the utilities.

Figure 17:
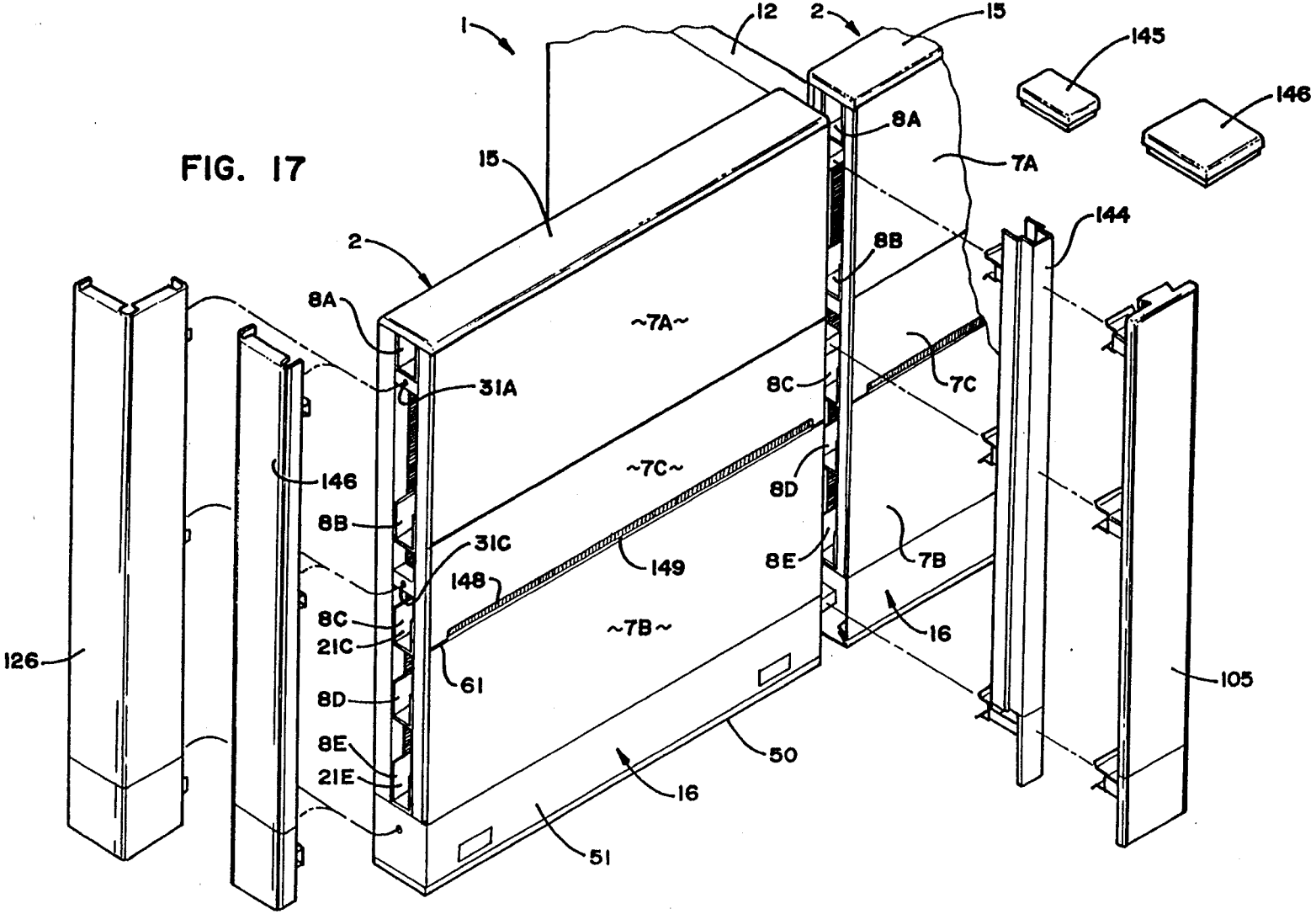
FIG. 17 is an exploded perspective view of a pair of utility panels interconnected with a partition panel by a T-panel connector.
Figures 18, 19, 20, 21:
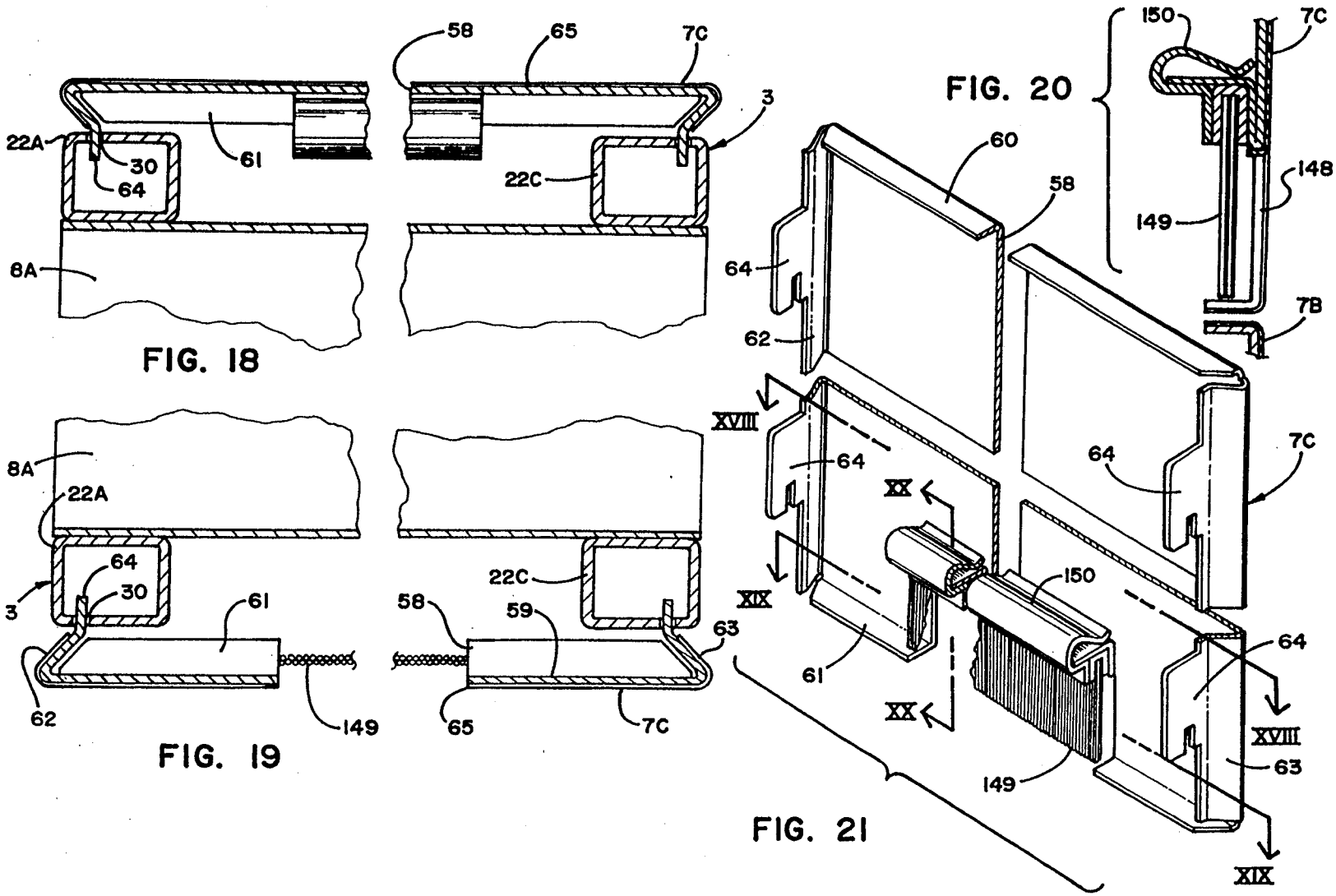
FIG. 18 is a fragmentary, horizontal cross-sectional view of the utility panel, taken along the line XVIII—XVIII of FIG. 21.
FIG. 19 is a fragmentary, horizontal cross-sectional view of the utility panel, taken along the line XIX—XIX of FIG. 21.
FIG. 20 is an enlarged, fragmentary, vertical cross-sectional view of the utility panel, taken along the line XX—XX of FIG. 21.
FIG. 21 is a fragmentary, perspective view of a removable cover panel for the utility panel.

FIG. 17 illustrates a pair of utility panels 2 interconnected with a "Series 9000" panel 12 in a "T" configuration. An alternative filler post 144 is illustrated for use in conjunction with thinner partition panels, as well as an associated top cap 145 to enclose the upper portion of the joint. A standard style top can 146 is also illustrated for use in conjunction with filler post 105. An end cap 146 is provided to cover the end of utility panel 2 in an end-of-run condition, and has a construction generally similar to filler post 105. The intermediate cover panel 7*c* illustrated in FIG. 17 includes a flexible accessway disposed along the lower edge 61 thereof. In the illustrated example, the lower edge 61 of cover panel 7*b* includes an elongate notch 148 which is selectively closed by a flexible strip 149, in nature of a brush or bristle, which is mounted immediately behind notch 148 by a clip 150 (FIG. 21). Flexible strip 149 permits wires to be easily drawn out from utility trough 8*c*, while maintaining a neat, closed appearance.

Figure 22:
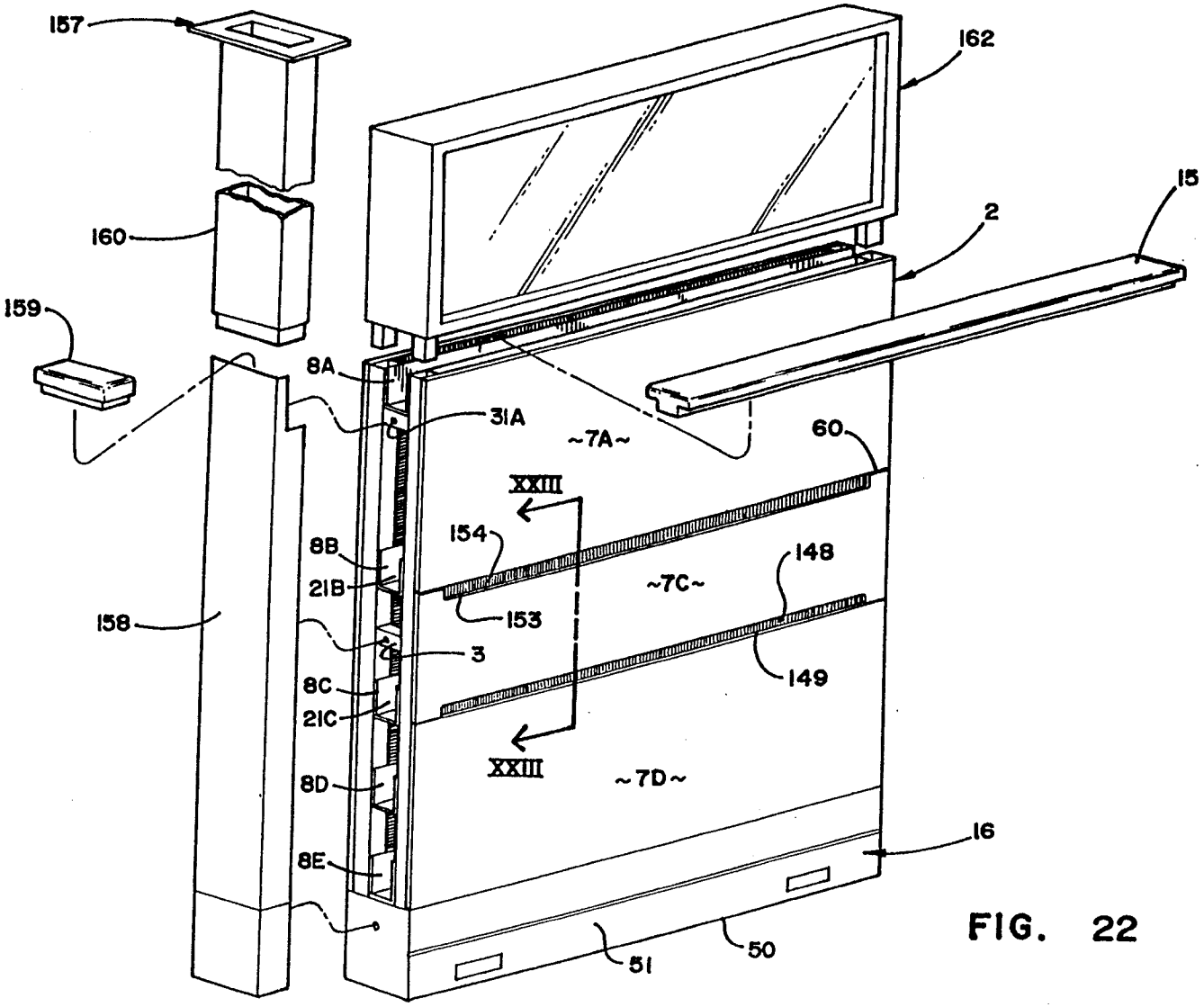
FIG. 22 is an exploded, perspective view of another embodiment of the utility panel.
Figures 23, 24:
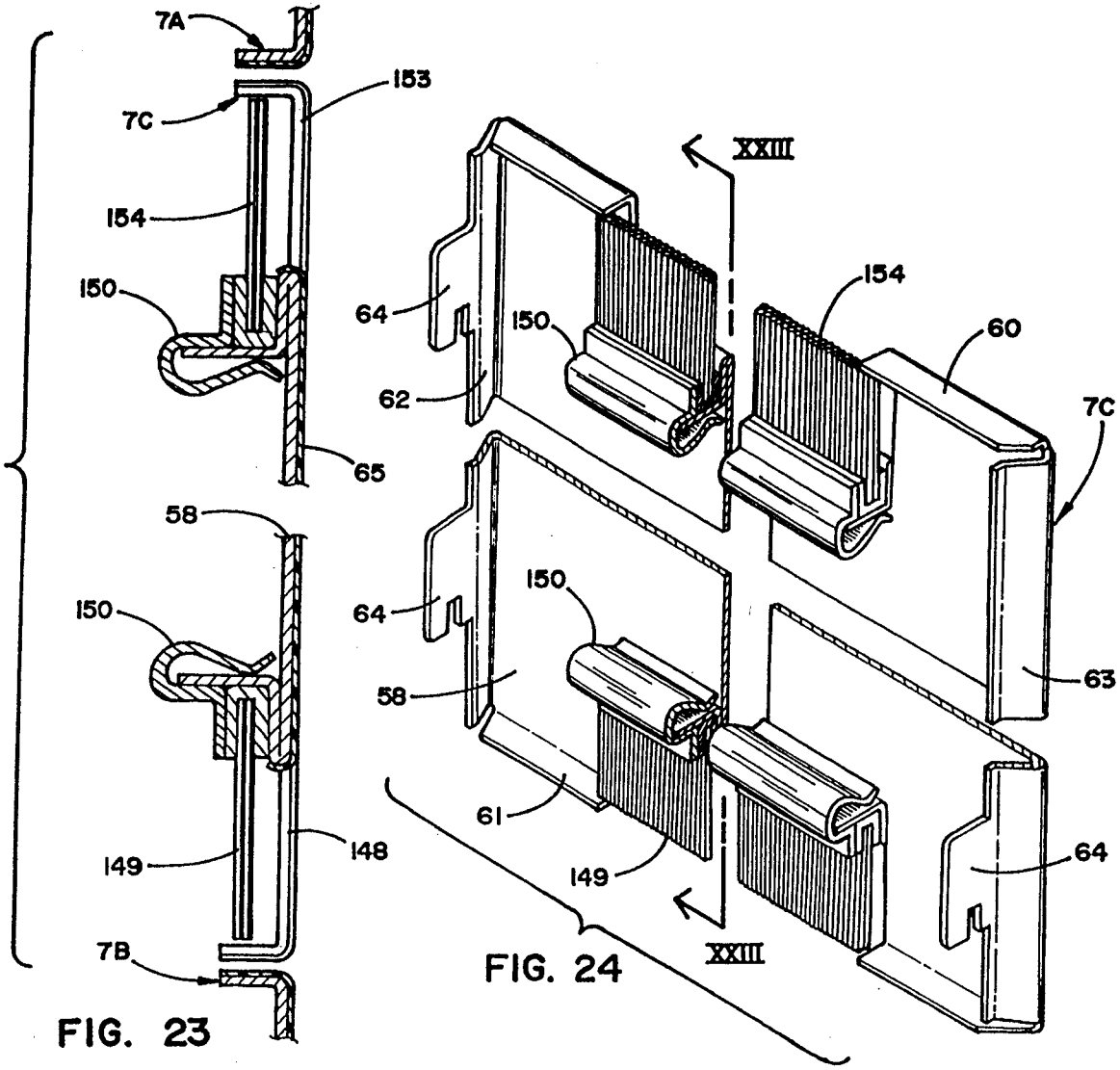
FIG. 23 is a fragmentary, vertical cross-sectional view of a center cover panel portion of the utility panel illustrated in FIG. 22, taken along the line XXIII—XXIII of FIG. 22.
FIG. 24 is a fragmentary, perspective view of the center cover panel illustrated in FIG. 22.

As best illustrated in FIG. 22, intermediate cover panels 7*c* may also have a second notch 153 and associated flexible strip 154 disposed along the upper edge 60 thereof. In this fashion, wires and/or other utilities can be easily drawn from utility trough 7*b* through the upper notch 153 and associated flexible strip 154.

Also illustrated in FIG. 22 is an optional top power-in channel assembly 157, which includes an end channel 158 that mounts with bolts (not shown) along one side of utility panel 2, and includes a closure cap 159, or an alternative top power-in extender tube 160. The utility panel 2 illustrated in FIG. 22 also includes an alternative top panel assembly or clerestory 162, which mounts to the top of utility panel 2, and can be used to extend the overall height of the utility panel.

Figure 25:
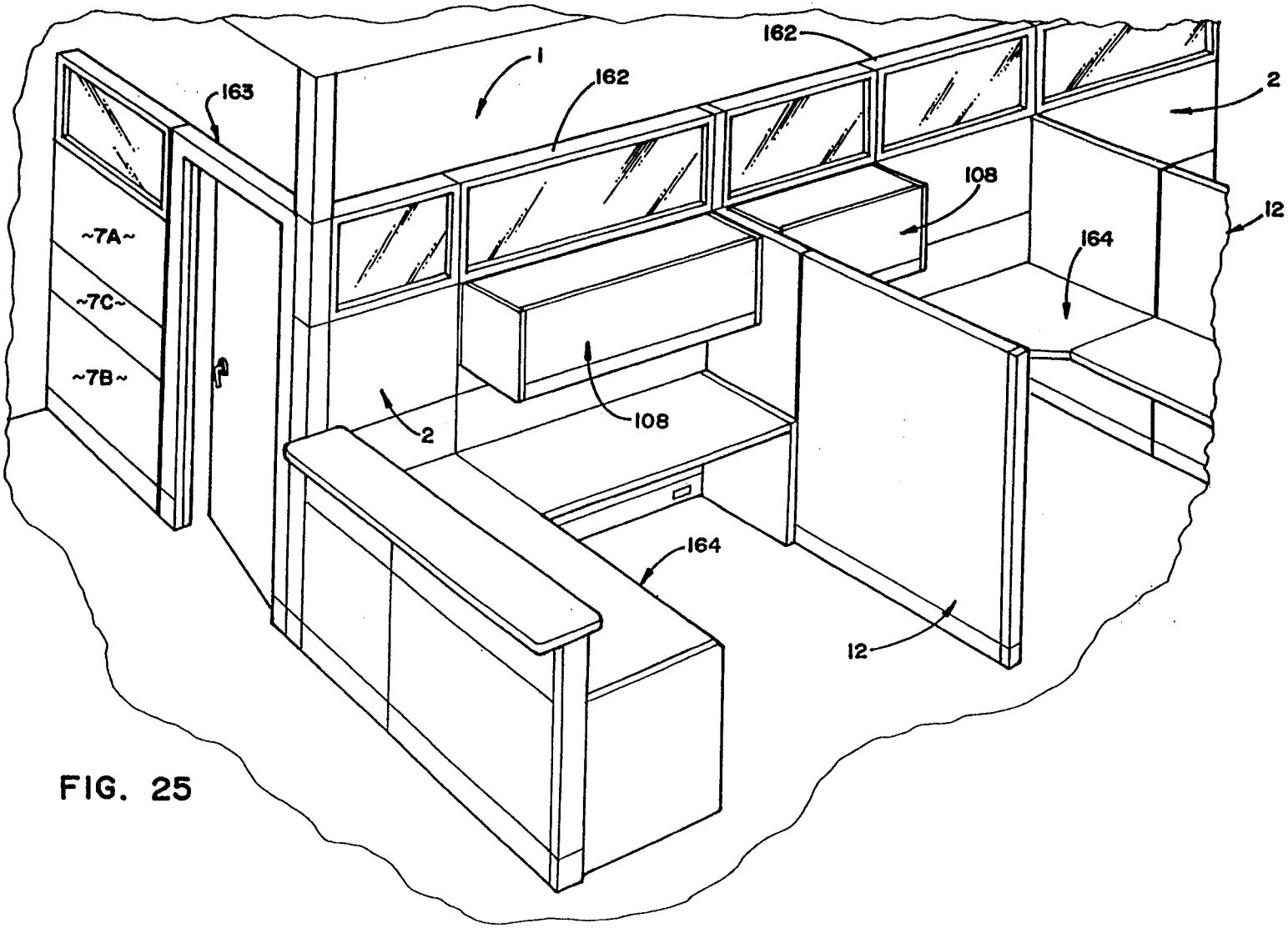
FIG. 25 is a perspective view of a combination panel system incorporating the present invention.

FIG. 25 illustrates a combination of utility panels 2 and "Series 9000" panels 12 that includes a mating door frame 163, hanging binder bins 108, and freestanding furniture 164.

FIG. 26–34 illustrate yet another embodiment of the present invention, wherein utility panels 2' are arranged in a spine configuration with different height "Series 9000" partition panels 12'. Since the alternative utility panel arrangement 1' is similar to the previously described utility panel system 1, similar parts appearing in FIGS. 1–25 and FIGS. 26–34 respectively are represented by the same, corresponding reference numeral, except for the prime suffix in the numerals of the latter.

Figure 26:
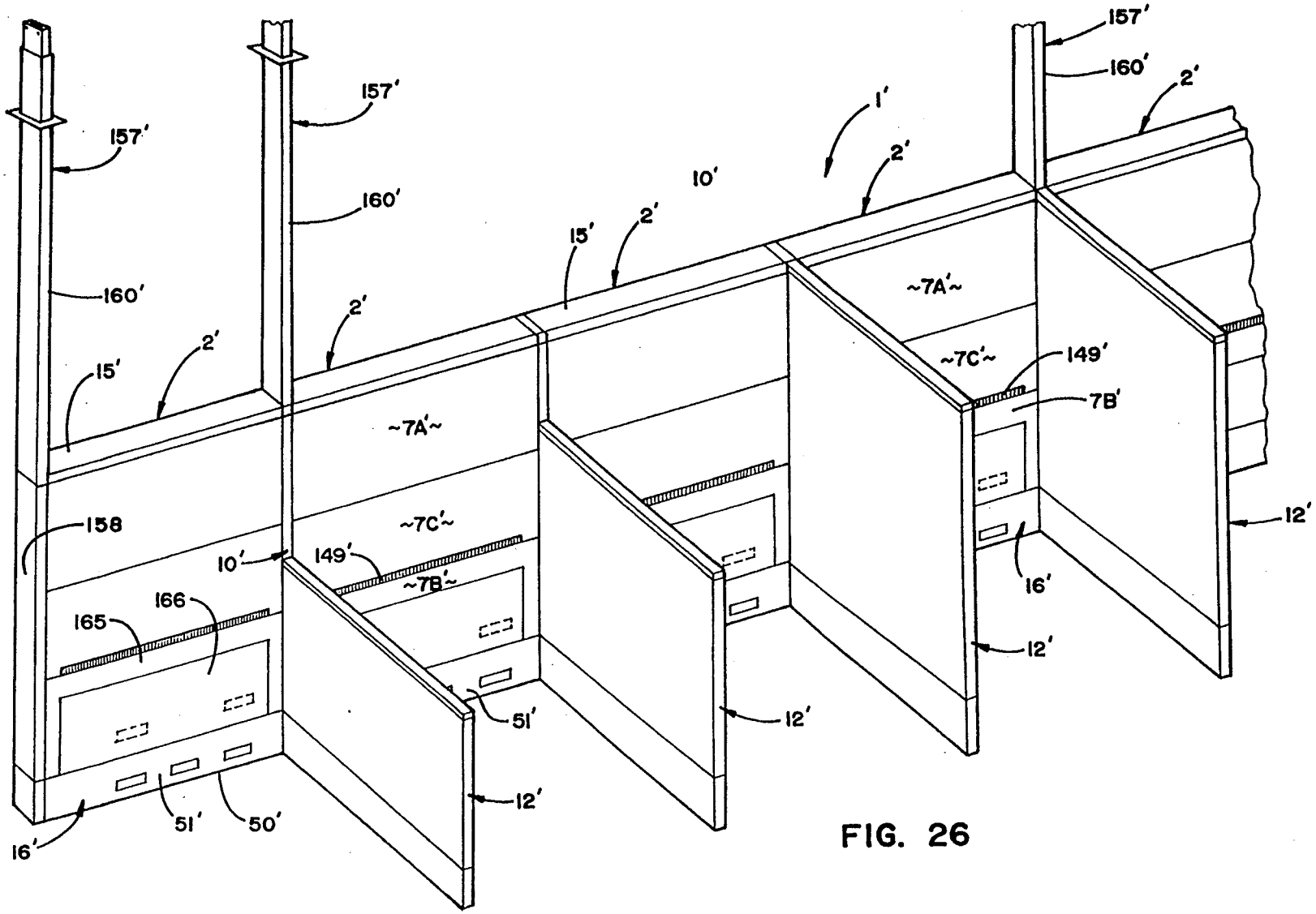
FIG. 26 is a perspective view of yet another embodiment of the present invention.
Figure 26A:
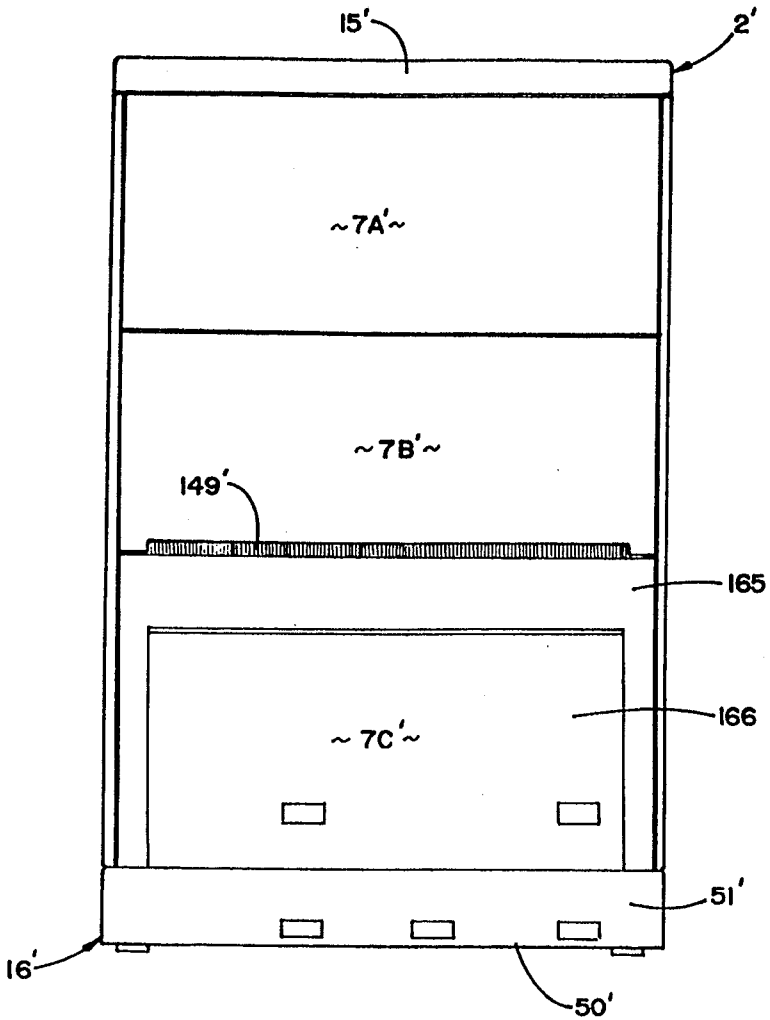
FIG. 26A is a front elevational view of the FIG. 26 embodiment of the present invention.

In utility panel system 1', adjacent utility panels 2' are arranged in an in-line spine configuration, with "Series 9000" panel connected thereto by T-connectors 110'. As best illustrated in FIGS. 26 and 26A, the lower cover panels 7*b'* of utility panels 2' have a two-part construction, comprising an outer cover panel 165, having an inverted U-shaped front elevational configuration, and an inner cover panel 166 mounted within the outer cover panel 165. Both cover panels 165 and 166 are detachably connected with the panel frame 3', and can be independently removed therefrom. Inner cover panel 166 is shaped such that it can be removed from panel frame 3', even when a worksurface is hung in place on utility panel 2'. This arrangement permits quick and easy rearrangement of utilities within utility panel 2'. The opposite, or aisle side (not shown) of utility panel 2', preferably has three plain cover panels 7', similar to the cover panels 7*a–c* illustrated in FIG. 3.

With reference to FIG. 26, the illustrated top power-in assembly 157' includes a separate, enclosed power raceway 177 which extends downwardly through extender 160' and end cap 158' into the base 16' of the associated utility panel 2' to provide electrical power to the system. A pair of top cable-in assemblies 178 are provided on two other utility panels 2' to route cabling throughout utility panel system 1'.

Figure 28:
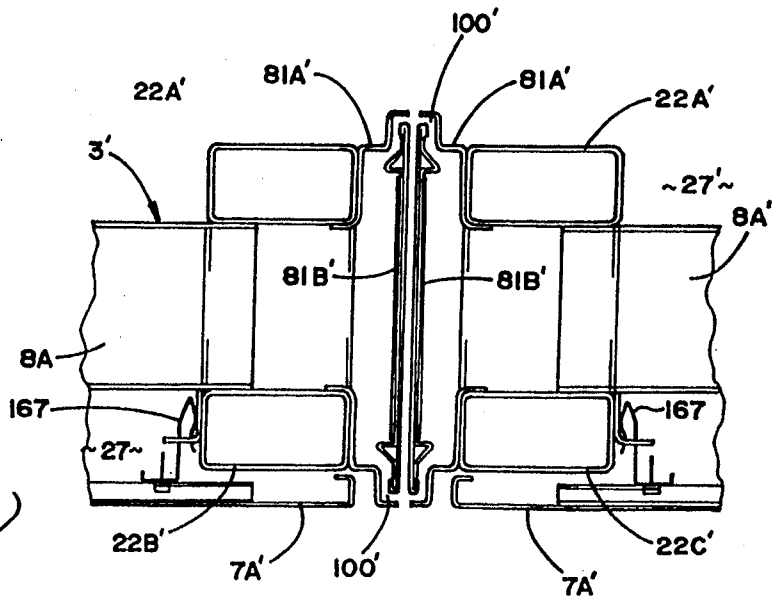
FIG. 28 is a fragmentary, horizontal cross-sectional view of the utility panels illustrated in FIGS. 26 and 27.
Figure 27:
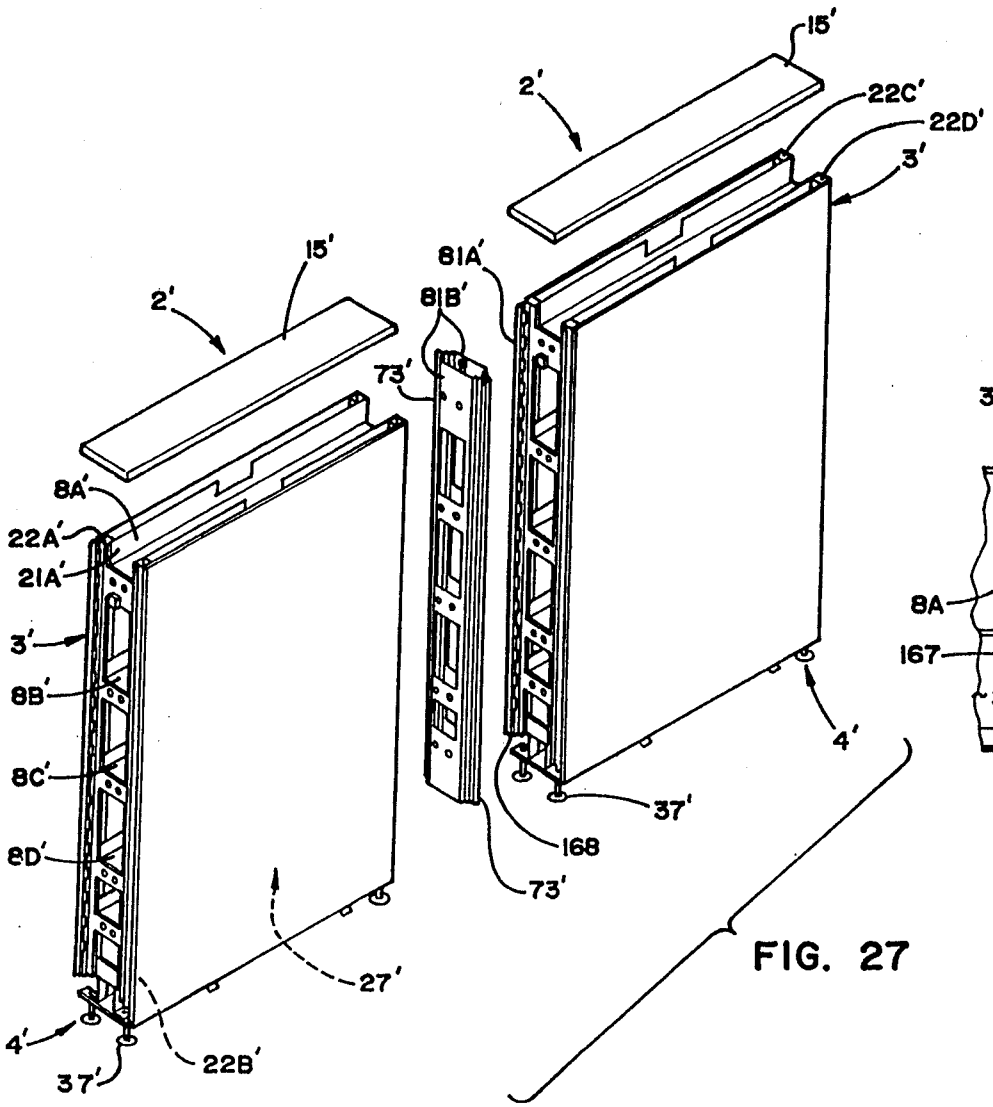
FIG. 27 is an exploded, perspective view of the FIG. 26 embodiment of the present invention, wherein adjacent utility panels are interconnected by a hinged, in-line panel connector.
Figure 29:
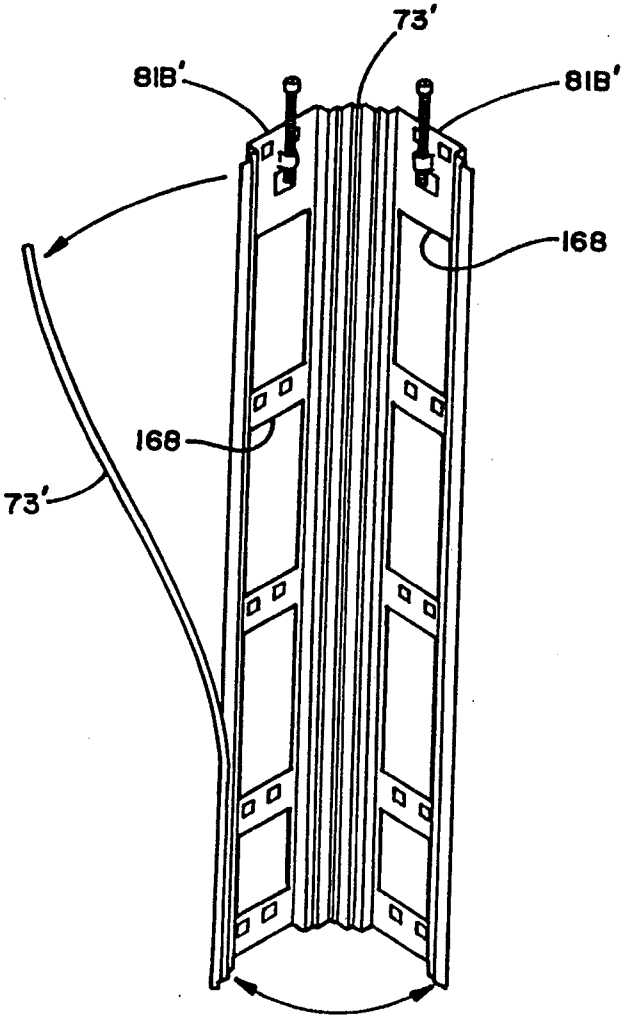
FIG. 29 is a perspective view of the hinged, in-line panel connector illustrated in FIGS. 26–28.

As best illustrated in FIGS. 27–29, in utility panel 2', the pairs of connector brackets 81' and 82' are formed in one-piece (hereinafter designated 81') with the inner halves 81*a''* of the brackets welded to the vertical uprights 22*a'–d'* of panel frame 3'. The exterior portions 81*b'* of brackets 81' are bolted to the interior portions 81a' thereof, and are in turn interconnected by a pair of flexible hinges 73'. Connector brackets 81' include a plurality of windows 168 in both halves arranged to be aligned with the utility troughs 8a'–e'. Cover panels 7' are attached to the associated panel frames 3' with spring clips 167 (FIG. 28), which permit removal of the cover panels 7' with a direct horizontal motion, thereby eliminating the need for clearance at the top and/or bottom of the cover panel for removal purposes.

Figure 30:
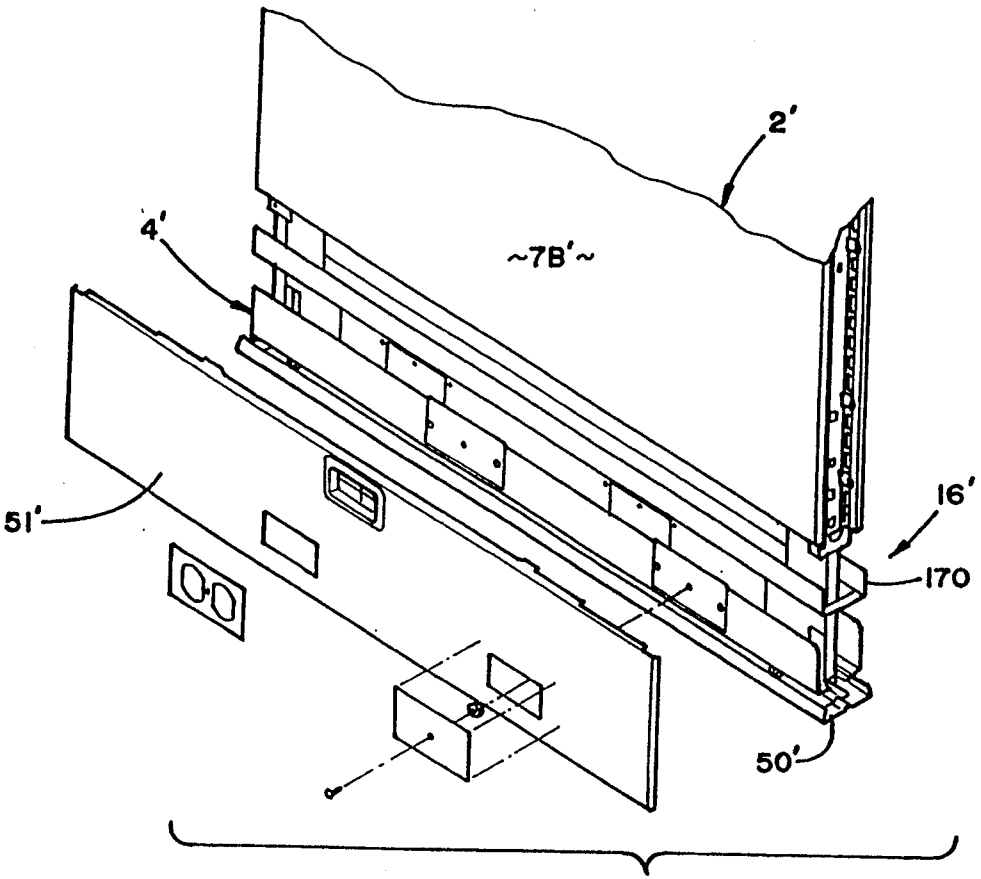
FIG. 30 is an exploded fragmentary perspective view of the utility panel illustrated in FIGS. 26–27.

As best illustrated in FIG. 30, the base assembly 16' of utility panel 2' is fully enclosed, and includes a bottom tray 170 enclosed by base cover panels 51' and 52'. Also, the utility troughs 8a'–e' (FIG. 27) of utility panel 2' are preferably spaced more than six inches apart to meet high level security requirements, especially with respect to eavesdropping, and other similar shielding problems.

Figure 32:
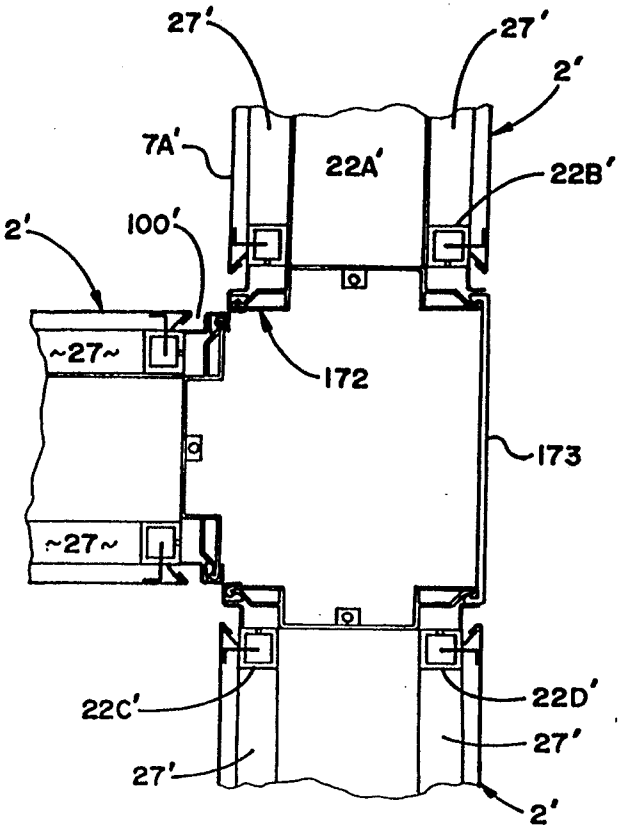
FIG. 32 is a fragmentary, horizontal cross-sectional view of the T-panel connector illustrated in FIG. 31.
Figure 31:
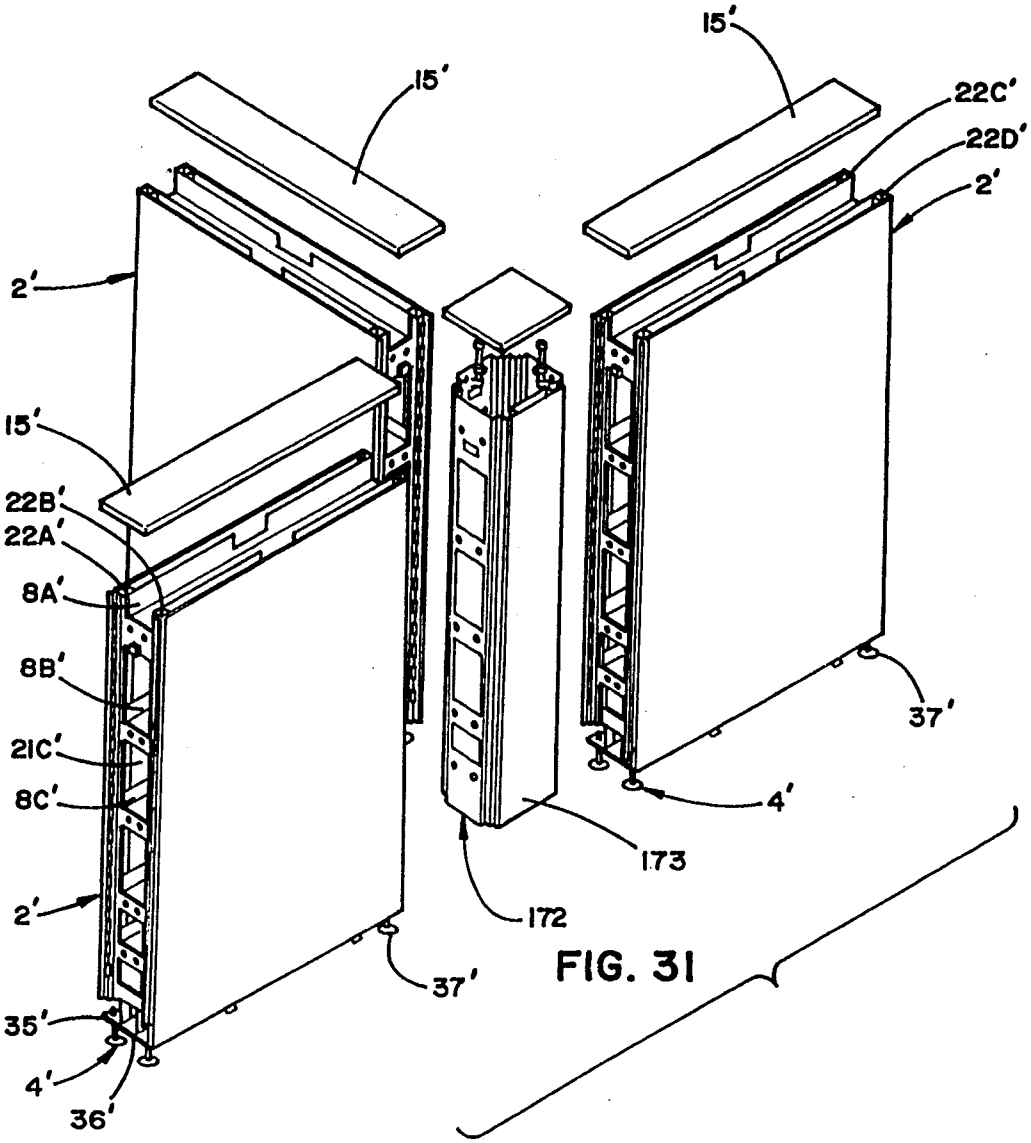
FIG. 31 is a perspective view of yet another embodiment of the present invention, wherein three utility panels are interconnected by a T-panel connector.

FIGS. 31 and 32 illustrate interconnecting three utility panels 2' in a T-configuration, using a T-connector 172. Each utility panel 2' has an innerbracket 81a' welded along the side edge thereof, with an associated outer bracket 81b' which form channels 100' in which flexible hinges 73' are received. An elongate cover 173 is mounted along the open side of the joint to enclose the same.

Figure 34:
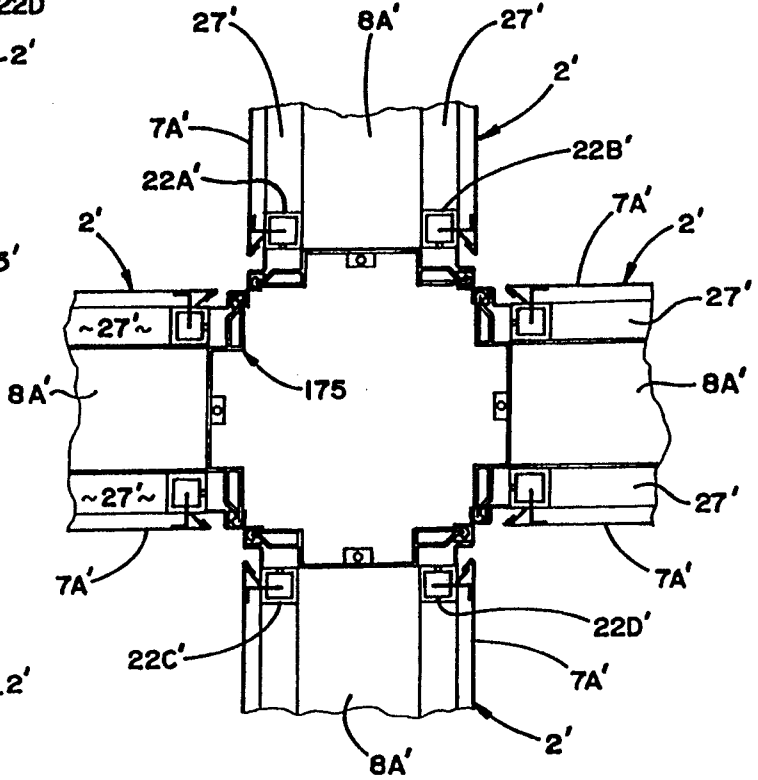
FIG. 34 is a fragmentary, horizontal cross-sectional view of the X-panel connector illustrated in FIG. 33.
Figure 33:
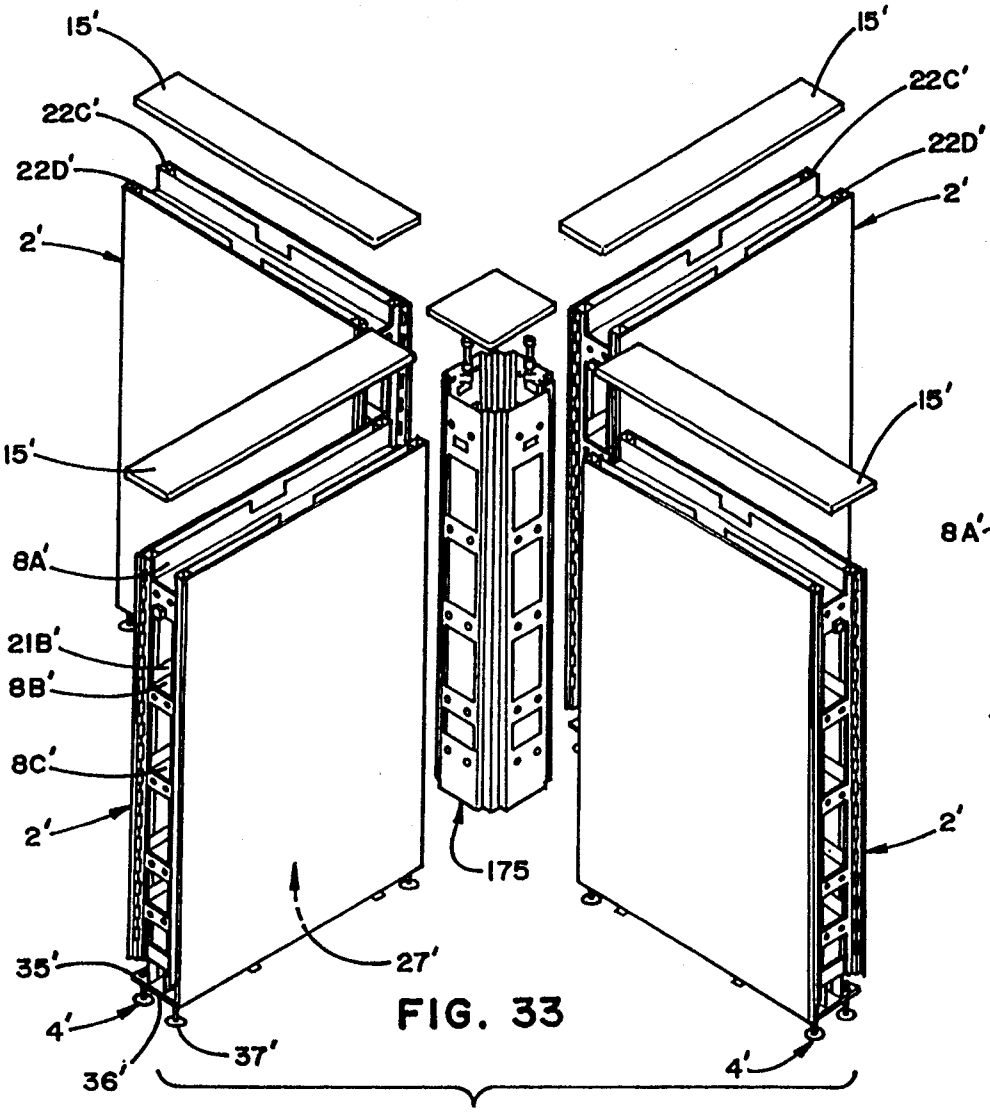
FIG. 33 is a perspective view of yet another embodiment of the present invention, wherein four utility panels are interconnected by an X-panel connector.

FIGS. 33 and 34 illustrate interconnecting four utility panels 2' in an X-configuration, using an X-connector 175. X-connector 175 is substantially identical to T-connector 172, except for the addition of an extra set of brackets 81' at the open side of the connector.

Figure 35:
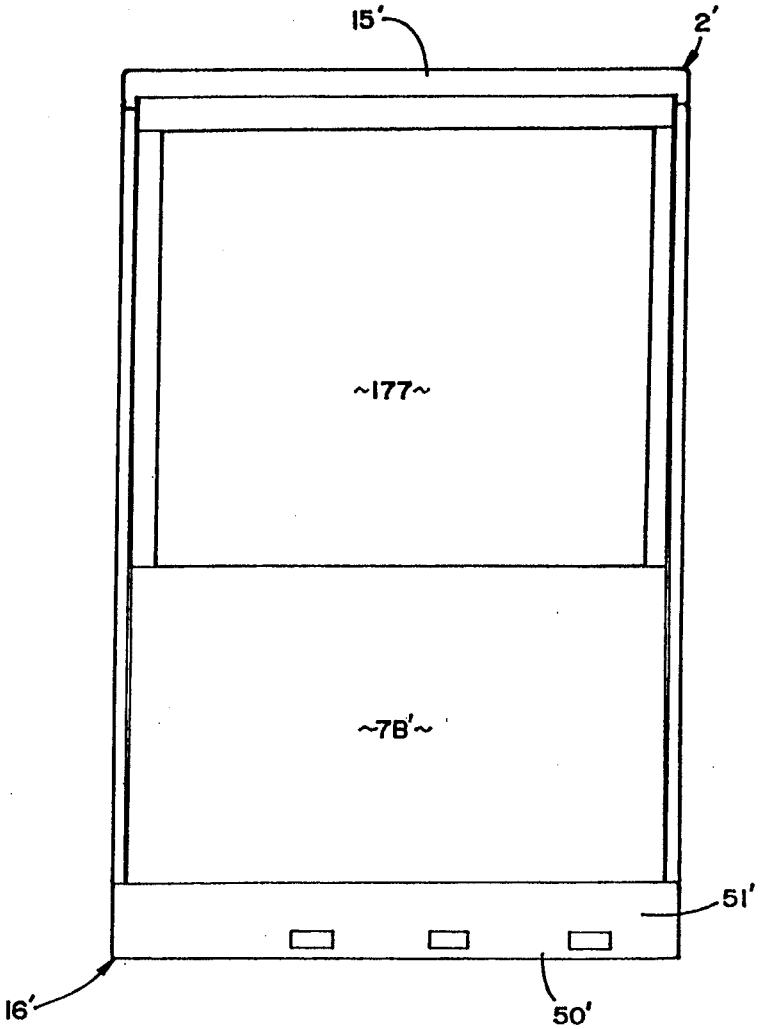
FIG. 35 is a front elevational view of yet another embodiment of the present invention.

FIG. 35 illustrates yet another embodiment of the present invention, wherein utility troughs 8b' and 8c' are detachably mounted within the associated panel frame 3'. In this manner, utility troughs 8b' and 8c' can be removed from frame and the cover panels 7' reconfigured to create a window or pass through 177 area in utility panel 2'.

A ventilation system 200 (FIGS. 36 and 37) is provided that is particularly adapted for use in the partition panel system of the present invention, although it is noted that the ventilation system is not contemplated to be limited to just this particular partition panel system. For example, ventilation system 200 may be used in other types of panel systems, as well as freestanding modular furniture arrangements and the like. In the illustrated example, ventilation system 200 (FIG. 36) includes an air source 201 and an elongate collapsible duct 202 connected thereto. Collapsible duct 202 can be collapsed for easy routing through the interior space of a partition panel system, and then pressurized and expanded during use to provide maximum cross-sectional area for maximum air flow.

Figure 36:
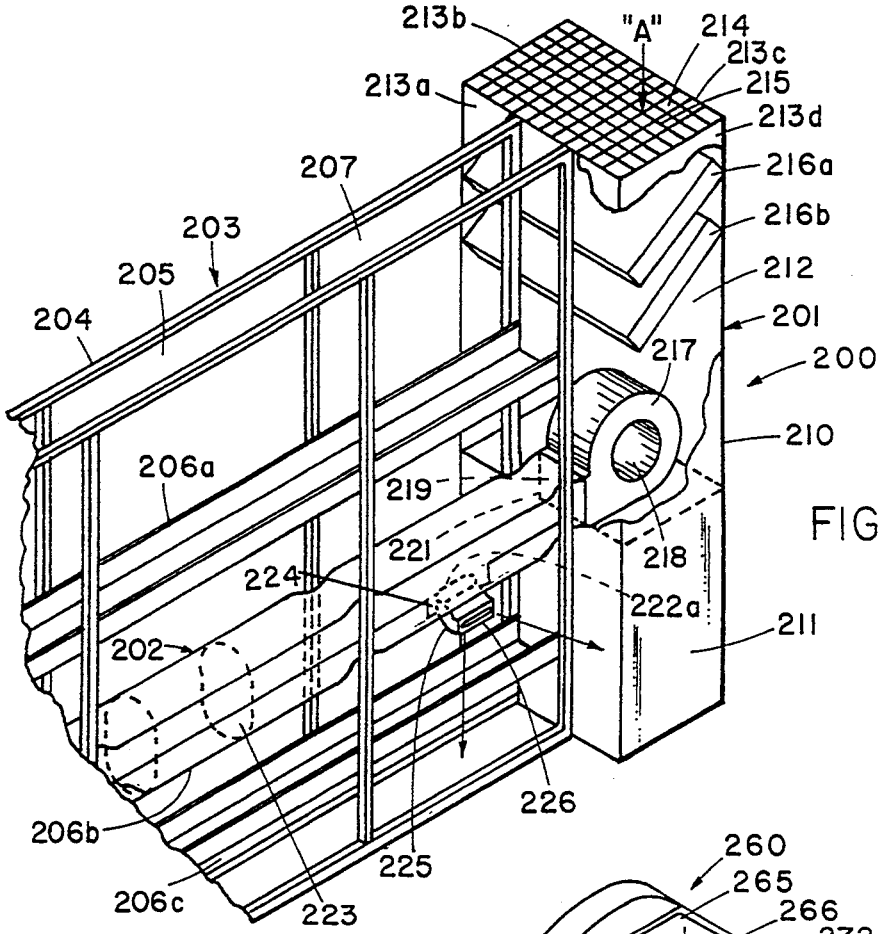
FIG. 36 is a perspective view of the utility panel system including a ventilation air source, and a collapsible duct positioned in the interior space of the utility panel system and connected to the air source for distributing ventilation air.

FIG. 36 illustrates a partition panel frame 203 with opposite subframes 204 and 205 interconnected by utility troughs or channels 206a, 206b and 206c. Partition panel frame 203 is constructed to cooperate with various shelves, cabinets, decks, and the like to define modular furniture units and workspaces. Channels 206a, 206b and 206c are adapted to support power lines and communication cabling comparably to utility troughs 8 previously described, and further are adapted to cooperate with subframes 204 and 205 to permit flexible routing of the power lines and communication cabling within the interior space 207 of frame 203. Removable partition panels 248 (FIG. 37) are attachable to the opposing sides of frame 203 to aesthetically cover items positioned in interior space 207.

Air source 201 (FIG. 36) includes a cabinet 210 adapted to be positioned proximate an end of partition panel frame 203. Cabinet 210 includes a lower base 211, and an upper chamber 212 defined by four side walls 213a, 213b, 213c and 213d extending upwardly from base 211. The upper edges of sidewalls 213a–213d define an inlet or opening 214 for accepting ventilation air "A" from an overhead ventilation system or from the space around the air inlet. A grating 215 covers inlet 214, and an optional air filter 216a and optional heating and/or cooling coils 216b are positioned therebelow. A fan or blower 217 is secured to the top of base 211. Fan 217 includes an inlet 218 and an outlet 219. Fan outlet 219 is oriented toward an aperture in sidewall 213a and is operably connected to an inlet opening 221 in one end of collapsible duct 202. Cabinet sidewall 213a is secured to an end of partition panel frame 203. Fan 220 is thus adapted to draw ventilation air through opening 214, optional air filter 216a and optional air heating/cooling coils 216b into fan inlet 218, and to urge ventilation air out fan inlet 219 through duct inlet opening 221 into collapsible duct 202. Optimally, fan 220 urges the ventilation air to move in a direction longitudinally aligned with partition panel frame 203, although it is contemplated that an L-shaped elbow or tee could be used to communicated ventilation air into partition panel frame 203 from a side thereof. In such case, cabinet 210 would be positioned beside partition panel frame 203 rather than at one end.

Collapsible duct 202 (FIG. 36) is an elongate duct having a closed interior defined by a sidewall constructed from a thin substantially imperforate, flexible film. Collapsible duct 202 includes the opening 221 adapted to receive ventilation air from air source 201. Preferably, opening 221 is located at an end of collapsible duct 202 as shown, although opening 221 could be located anywhere in collapsible duct 202. Collapsible duct 202 further includes a plurality of second openings 222a (FIG. 36) and 222b (FIG. 37) for distributing the ventilation air to associated workspaces.

Collapsible duct 202 can be routed substantially anywhere within the interior space 207 of partition panel frame 203. It is particularly adapted to route over, around or through areas within interior space 207 where there is limited cross-sectional area available due to the routing of power lines or communication cabling, or where the path is somewhat tortuous. Collapsible duct 202 is intended to be installed in a collapsed state. Once installed, collapsible duct 202 is inflatable to an enlarged cross-sectional area within the interior space, thus minimizing air flow resistance and maximizing air flow.

Collapsible duct 202 (FIG. 36) is typically positioned in one of channels 206, although it can be routed between channels. Channels 206 include sidewalls 223 with notches 224 therein to facilitate wire ingress/egress. With collapsible duct 202 positioned in channel 206, second duct opening 222a is located at a notch 224. A short semi-rigid tubular duct 225 is connected to duct opening 222a to communicate ventilation air from duct opening 222a to a diffuser 226. Diffuser 226 can be attached to a removable panel (not shown) covering partition panel frame 203, or diffuser 226 can be secured to channel sidewall 223 so that it is positioned to direct air through an opening in the removable panel.

Figure 37:
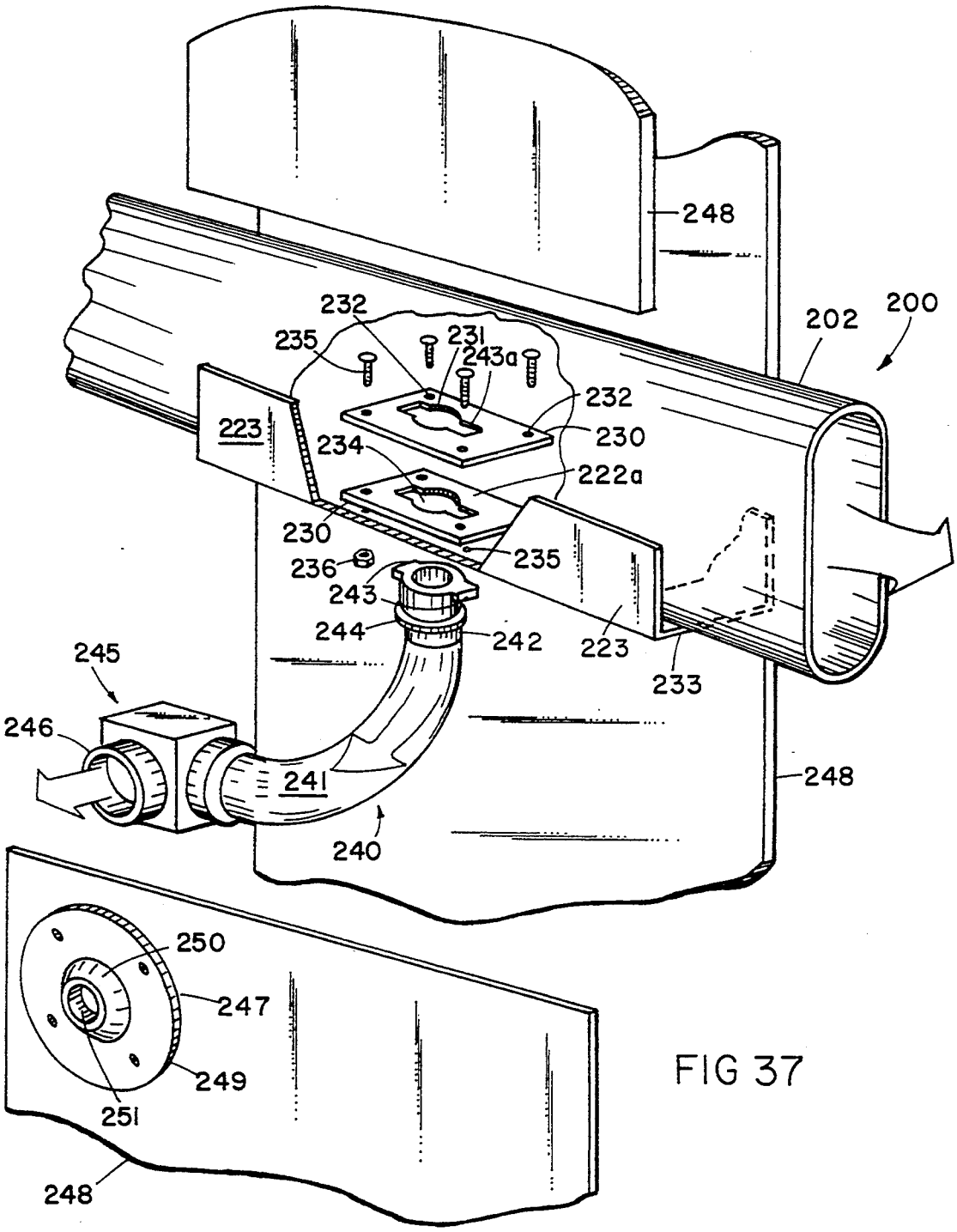
FIG. 37 is an exploded fragmentary perspective view of the collapsible duct and utility panel system, the portion of the collapsible duct including a flexible tube connected thereto for communicating ventilation air from the collapsible duct to a diffuser located as desired.

Another arrangement for distributing ventilation air from collapsible duct 202 is illustrated in FIG. 37. A pair of adapter plates 230 each include an enlarged central opening 231 with attachment holes 232 positioned therearound. Channel 206 includes a bottom wall 233 with a corresponding enlarged shaped central opening 234 and attachment holes 235. Second opening **222*b* is aligned with central openings 231 and 234, and adapter plates 230 are clamped in a sandwich-like manner against the duct material forming second opening 222*b* and against channel bottom wall 233 by bolts 235 and locking nut 236. In practice, plates 230 can be sandwiched together and secured to channel bottom wall 233 before opening 222*b* is formed in collapsible duct 202. This allows adapter plate openings 231 to act as templates when cutting hole 222*b*. Also, it is contemplated that plates 230 can be made of sufficient weight so that plates 230 do not need to be secured to channel 206**.

A flexible tube 240 (FIG. 37) includes a flexible tubular body 241 with a twist connector 242 connected to one end. Twist connector 242 is adapted to slip into the combined central opening formed by members 222, 231, and the opening **222*b* in duct 202, and sealingly connect thereto. In particular, twist connector 242 includes opposing ears 243 that slip mateably through aligned cutouts 243a in central openings 222, 231, and 234. Twist connector 242 also includes a sealing ring 244 spaced below opposing ears 243. When twist connector 242 is positioned in openings 222, 231, and 234 and rotated 90 degrees, opposing ears 243 engage inner adapter plate 230 on the inside surface, causing sealing ring 244 to sealingly engage channel bottom wall 233 on the outside surface. Thus, a substantially air-tight seal is made with collapsible duct 202 at second opening 222*b***.

The other end of flexible tube 240 includes a box-shaped connector 245. Connector 245 includes a sleeve 246 adapted to sealing engage a diffuser 247 located in removable panel 248. Removable panel 248 is attachable to partition panel frame 203 in a manner previously described in this application. Diffuser 247 includes an attachment bracket 249 that clamps into a hole in removable panel 248. Attachment bracket 249 defines a spherical bearing for operably supporting a spherical rotatable diffuser ball 250 therein, and further defines a tube-like flange (not shown) for receiving sleeve 246. Diffuser ball 250 includes an enlarged hole 251 that extends through ball 250, and which is useful for communicating ventilation air through movable panel 248. With removable panel 248 installed, sleeve 246 seals against the inside of attachment bracket 249 so that ventilation air is forced through enlarged hole 251 of ball 250. By selectively orienting ball 250, ventilation air is thus directed as desired.

Figure 38:
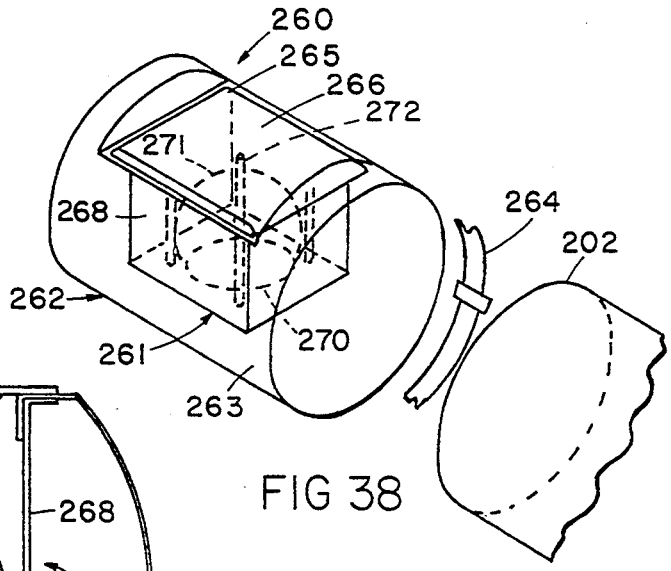
FIG. 38 is a perspective view of a pressure relief system connectable to the collapsible duct for regulating air pressure therein.
Figure 39:
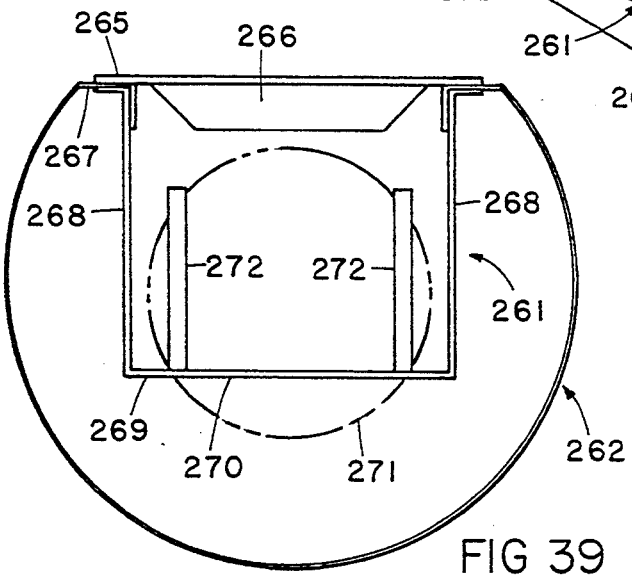
FIG. 39 is an end view of the pressure valve in FIG. 38.

A pressure relief system 260 (FIGS. 38 and 39) is provided to prevent over-pressurization of ventilation air in collapsible duct 202. Pressure relief valve 260 is located at an end of collapsible duct 202, and sealingly closes off the end of collapsible duct 202. Pressure relief system 260 includes a closed box-shaped inner housing 261 mounted in a barrel-shaped outer housing 262. Outer housing 262 is adapted to securely connect to the end of collapsible duct 202, such as by telescopingly receiving collapsible duct 202 onto an end flange 263 of housing 262. A hose clamp 264 can then be used to secure the assembly together. Outer housing 262 defines an aperture 266 on a top side thereof. A flanged picture-frame-like bracket 265 (FIG. 38) sealingly engages the marginal edge 267 defining the aperture 266 in a sandwich-like arrangement with the top of housing 262. Inner housing 261 includes closed sides 268 and a bottom panel 269, with bottom panel 269 including a hole 270. A weighted sphere 271 having a diameter larger than hole 270 is placed in housing 261. Elongated pegs 271 protrude upwardly from bottom panel 269 around hole 270 to keep sphere 271 centrally located over hole 270 as sphere 271 is moved vertically by air pressure and air flow. The weight of sphere 271 is predetermined and calculated to hold sphere 271 matingly over hole 270 so that sphere 271 sealingly closes off hole 270 until a maximum predetermined pressure is reached in duct 202. At that time, sphere 271 is lifted by air pressure so that air is allowed to flow around sphere 271 and flow out of hole 270. This prevents a particular workspace from receiving an excessive amount of air if the air diffusers at the other workspaces are closed off, and also prevents collapsible duct 202 from otherwise overexpanding due to excessive internal air pressure.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A collapsible duct for open office partition panel systems, of the type having channel-shaped supports, said duct comprising:

an elongate duct body having a closed interior defined by a sidewall constructed from a thin, substantially imperforate, flexible film material, and configured to conduct ventilation air therealong; said duct body having a first opening shaped to communicate with a source of pressurized ventilation air, and a laterally facing second opening in said sidewall shaped to communicate with at least one diffuser to disperse ventilation air into an associated workspace; said duct body having a nonrigid and nonreinforced construction which permits said duct body to be laterally collapsed and locally deformed to facilitate threading said duct body through associated partition panels; and a bracket for engaging the material defining said second opening to retain the shape of said second opening and for engaging one of the channel-shaped supports to retain the duct body in the one support, whereby during operation, pressurized ventilation air from the source inflates said duct body and automatically expands the same laterally to a configuration which maximizes ventilation air flow therethrough, while minimizing resistance to the flow.

2. A collapsible duct as defined in claim 1 including means for communicating ventilation air from said second opening to a diffuser positioned remotely from said second opening.

3. A collapsible duct as defined in claim 2 wherein said means for communicating includes a flexible tube adapted to communicate ventilation air from said elongate duct body to a diffuser, said flexible tube including one end operably connected to said second opening by a connecting means and including another end positioned in a desired location in the associated workspace.

4. A collapsible duct as defined in claim 1 wherein said bracket includes an inner member and an outer member that clamp together in a sandwich-like arrangement on the material forming said second opening.

5. A collapsible duct as defined in claim 1 wherein said bracket is configured to engage a hole in the channel-shaped support to hold said elongate duct body in a desired position in the channel-shaped support.

6. A collapsible duct as defined in claim 1 wherein said elongate duct body includes a plurality of air dispensing openings including said second opening.

7. A collapsible duct as defined in claim 6 including a plurality of flexible dispensing tubes operably connected to said plurality of second openings.

8. A collapsible duct assembly as defined in claim 6 including a pressure relief system connected to one of said plurality of air dispensing openings on said elongate duct body for venting the ventilation air in said elongate duct body when the air pressure in the elongate duct body reaches a predetermined maximum amount.

9. A duct assembly for open office partition panel systems and the like, comprising:

an elongate duct having a closed interior defined by a sidewall constructed from a thin, substantially imperforate, flexible film material, and configured to conduct ventilation air therealong; said duct having a first opening shaped to communicate with a source of pressurized ventilation air, and at least one second opening shaped to communicate with at least one diffuser to disperse ventilation air into an associated workspace; said duct having a nonrigid and nonreinforced construction which permits said duct to be laterally collapsed and locally deformed to facilitate threading said duct through associated partition panels; a flexible tube for communicating ventilation air from said second opening to a diffuser positioned remotely from said second opening, said flexible tube including one end operably connected to said second opening by a connecting means and including another end positioned in a desired location in the associated workspace; said connecting means including an inner member and an outer member that clamp together in a sandwich-like arrangement on the material forming said second opening, said outer member including means for securing said outer member in a channel-shaped support, whereby during operation, pressurized ventilation air from the source inflates said duct and automatically expands the same laterally to a configuration which maximizes ventilation air flow therethrough, while minimizing resistance to the flow.

10. A duct assembly as defined in claim 9 wherein said elongate duct includes a plurality of said second openings, and including a plurality of said flexible tubes operably connected to said plurality of second openings.

11. A duct assembly as defined in claim 10 including a pressure relief system connected to said elongate duct for venting the ventilation air in said elongate duct when the air pressure in the elongate duct reaches a predetermined maximum amount.

12. A partition system for open office spaces, comprising:

a plurality of freestanding portable partition panels detachably interconnected to form at least one workstation; said partition panels each including a rigid panel frame with opposite sides and a hollow interior portion to facilitate routing electrical and non-electrical utility lines therethrough for use in said at least one workstation, and at least one cover panel shaped to cover at least a portion of one of the opposite sides of said panel frame, and being detachably connected therewith to provide ready access to the interior portion of the associated one of said partition panels, said partition panels each further including at least one laterally extending channel attached to said rigid panel frame in said hollow interior portion; and a collapsible duct having a closed interior defined by a sidewall constructed from a thin, substantially imperforate, flexible film, and configured to rest in said at least one channel and to conduct ventilation air therealong; said duct having a first opening shaped to communicate with a source of pressurized ventilation air, and a second opening intermediate the length of the collapsible duct shaped to communicate with at least one diffuser to disperse ventilation air into said workstation; said duct having a nonrigid and nonreinforced construction which permits said duct to be laterally collapsed and locally deformed to facilitate threading said duct through the interior portions of said partition panels, whereby during operation, pressurized ventilation air from the source inflates said duct and automatically expands the same laterally to a configuration which maximizes ventilation air flow therethrough, while minimizing resistance to the flow.

13. A partition system as defined in claim 12 including means for moving air operably connected to said first opening.

14. A partition system as defined in claim 13 including a cabinet for housing said means for moving air.

15. A partition system as defined in claim 14 wherein said cabinet is positioned exteriorly of said at least one workstation.

16. A partition system as defined in claim 15 wherein said cabinet includes an upwardly facing air inlet for accepting ventilation air from an overhead ventilation system.

17. A partition system as defined in claim 12 including means for communicating ventilation air from said second opening to a diffuser positioned remotely from said second opening.

18. A partition system as defined in claim 17 wherein said means for communicating includes a flexible tube adapted to communicate ventilation air from said elongate duct to a diffuser, said flexible tube including one end with means for operably connecting to said second opening and including another end positioned in a desired location in the associated workspace.

19. A partition system as defined in claim 18 wherein said connecting means includes an inner member and an outer member that clamp together in a sandwich-like arrangement on the material forming said second opening.

20. A partition system as defined in claim 12 including means for supporting said collapsible duct, said means for supporting being located in the interior portions of said partition panels.

21. A partition system as defined in claim 12 wherein said elongate duct includes a plurality of air dispensing openings including said second opening.

22. A partition system as defined in claim 21 including a plurality of dispensing tubes operably connected to said plurality of second openings.

23. A partition system as defined in claim 12 including a pressure relief system connected to said elongate duct for venting the ventilation air in said elongate duct when the air pressure in the elongate duct reaches a predetermined maximum amount.

24. A workstation ventilation system, comprising:

a source of pressurized ventilation air;

a plurality of modular furniture units arranged in a plan configuration defining workstations, said plurality of modular furniture units including means defining a laterally extending space that extends from one side to another side of each workstation and which join to form a continuous elongated space and further including at least one laterally extending channel attached to said means and located in said laterally extending space;

an air diffuser located at at least one workstation; and an elongate collapsible duct having a closed interior defined by an imperforate flexible sidewall material, said duct being configured to mateably rest in said at least one channel and to extend along said continuous elongated space to conduct ventilation air from said source to said at least one workstation; said duct having a first opening shaped to communicate with the source of pressurized ventilation air and engaged therewith, and a laterally facing second opening shaped to communicate with said diffuser to disperse ventilation air into said at least one workstation; said duct being laterally collapsible and locally deformable to facilitate threading said duct through the laterally extending spaces in said plurality of modular furniture units and including rigidifying members for engaging the marginal material defining said second opening whereby during operation, pressurized ventilation air from the source inflates said duct and automatically expands the same laterally to a configuration which maximizes ventilation air flow therethrough, while minimizing resistance to the flow.

25. A workstation ventilation system as defined in claim 24 including a cabinet for housing said source of pressurized ventilation air.

26. A workstation ventilation system as defined in claim 24 including means for communicating ventilation air from said second opening to a diffuser positioned remotely from said second opening.

27. A workstation ventilation system as defined in claim 25 wherein said means for communicating includes a flexible tube adapted to communicate ventilation air from said elongate duct to a diffuser, said flexible tube including one end with means for operably connecting to said second opening and including another end positioned in a desired location in the associated workspace.

28. A workstation ventilation system as defined in claim 24 wherein said elongate duct includes a plurality of air dispensing openings including said second opening.

29. A workstation ventilation system as defined in claim 28 including a plurality of dispensing tubes operably connected to said plurality of air dispensing openings.

30. A workstation ventilation system as defined in claim 24 including a pressure relief system connected to said elongate duct for venting the ventilation air in said elongate duct when the air pressure in the elongate duct reaches a predetermined maximum amount.

31. A method comprising:

providing a plurality of freestanding partition panels each having an interior space extending from one side to another side and including a channel-shaped support attached to the partition panel and located in the interior space for carrying electrical and non-electrical utility lines for workstations, the interior spaces joining to form a continuous elongate space;

providing a collapsible duct having a closed interior defined by a sidewall constructed by a thin, substantially imperforate, flexible film and configured to conduct ventilation air therethrough;

extending the collapsible duct in a collapsed state through the continuous elongate space and resting the collapsible duct on the channel-shaped supports; and inflating the collapsible duct so as to expand the collapsible duct to the maximum allowable shape to communicate ventilation air therethrough.

* * * * *